US011641897B2

(12) United States Patent
Moore et al.

(10) Patent No.: US 11,641,897 B2
(45) Date of Patent: May 9, 2023

(54) ARTICLE OF CLOTHING INCLUDING A SUBSTRATE MATERIAL AND A FLOCKING MATERIAL

(71) Applicant: Hurley International LLC, Costa Mesa, CA (US)

(72) Inventors: Bruce Y. Moore, Laguna Beach, CA (US); David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 440 days.

(21) Appl. No.: 16/084,360

(22) PCT Filed: Mar. 10, 2017

(86) PCT No.: PCT/US2017/021754
§ 371 (c)(1),
(2) Date: Sep. 12, 2018

(87) PCT Pub. No.: WO2017/156376
PCT Pub. Date: Sep. 14, 2017

(65) Prior Publication Data

US 2019/0090562 A1 Mar. 28, 2019

Related U.S. Application Data

(60) Provisional application No. 62/306,319, filed on Mar. 10, 2016.

(51) Int. Cl.
*A41D 27/10* (2006.01)
*A41F 9/00* (2006.01)
(Continued)

(52) U.S. Cl.
CPC ..... *A41D 27/10* (2013.01); *A41B 1/12* (2013.01); *A41B 17/00* (2013.01); *A41D 1/06* (2013.01);
(Continued)

(58) Field of Classification Search
CPC ..... A41D 2400/24; A41D 1/06; A41D 1/08; A41D 1/082; A41D 1/084; A41D 1/085;
(Continued)

(56) References Cited

U.S. PATENT DOCUMENTS 1,995,734 A 3/1935 Callahan
3,133,543 A 5/1964 Ernest
(Continued)

FOREIGN PATENT DOCUMENTS

CN 100577046 C 1/2010
CN 103653373 A 3/2014
(Continued)

OTHER PUBLICATIONS

China National Intellectual Property Administration, Office Action for CN Application No. 201780016446.5, dated Oct. 10, 2019.
(Continued)

*Primary Examiner* — Alissa J Tompkins
*Assistant Examiner* — Brieanna Szafran
(74) *Attorney, Agent, or Firm* — Honigman LLP; Matthew H. Szalach; Jonathan P. O'Brien

(57) ABSTRACT

An article of clothing is provided and includes a substrate material including an inner surface and an outer surface disposed on an opposite side of the substrate material than the inner surface. The substrate material forming a body-receiving portion and a limb-receiving portion extending from the body-receiving portion, whereby the body-receiving portion includes a first opening sized for circumscribing a neck of the wearer and the limb-receiving portion includes a second opening sized for circumscribing a limb of the wearer. A flocking material is arranged adjacent the inner surface of the substrate material proximate at least one of the first opening and the second opening.

20 Claims, 10 Drawing Sheets

(51) Int. Cl.

| | |
|---|---|
| ***A41D 27/18*** | (2006.01) |
| ***A41D 1/089*** | (2018.01) |
| ***A41B 1/12*** | (2006.01) |
| ***A41B 17/00*** | (2006.01) |
| ***A41D 1/06*** | (2006.01) |
| ***A41D 13/00*** | (2006.01) |

(52) U.S. Cl.
CPC ..... *A41D 1/089* (2018.01); *A41D 27/18* (2013.01); *A41F 9/00* (2013.01); *A41B 2400/82* (2013.01); *A41D 13/0015* (2013.01); *A41D 2400/24* (2013.01); *A41D 2400/82* (2013.01)

(58) Field of Classification Search
CPC ..... A41D 1/086; A41D 13/00; A41D 13/02; A41D 13/0005; A41D 13/0543; A41B 2400/82; A41B 17/005; A63B 71/1225
See application file for complete search history.

(56) References Cited

U.S. PATENT DOCUMENTS

| | | | | |
|---|---|---|---|---|
| 3,298,373 | A * | 1/1967 | Marchisella | A41C 1/02 450/99 |
| 4,180,606 | A * | 12/1979 | Hance | D04H 11/00 427/198 |
| 4,438,533 | A * | 3/1984 | Hefele | D04H 11/00 2/232 |
| 4,757,557 | A * | 7/1988 | Hirano | A41D 19/0055 2/164 |
| 5,206,957 | A | 5/1993 | Gulick | |
| 7,581,258 | B2 * | 9/2009 | Baron | D04H 11/00 2/69 |
| 8,533,864 | B1 * | 9/2013 | Kostrzewski | A41D 31/185 2/69 |
| 2006/0080755 | A1 | 4/2006 | Baron et al. | |
| 2006/0130215 | A1 * | 6/2006 | Torry | A41D 13/065 2/227 |
| 2007/0074328 | A1 * | 4/2007 | Melhart | A41D 13/0015 2/69 |
| 2009/0271914 | A1 | 11/2009 | Bauer | |
| 2011/0083246 | A1 | 4/2011 | Vitarana | |
| 2013/0212767 | A1 * | 8/2013 | Nordstom | A41D 31/185 2/69 |
| 2014/0182048 | A1 | 7/2014 | Gregory | |
| 2014/0208484 | A1 | 7/2014 | Huff et al. | |
| 2015/0038052 | A1 * | 2/2015 | Hays | A41C 5/00 450/154 |
| 2015/0093537 | A1 | 4/2015 | Cain | |

FOREIGN PATENT DOCUMENTS

| | | | |
|---|---|---|---|
| CN | 104041949 | A | 9/2014 |
| CN | 104203019 | A | 12/2014 |
| CN | 104955348 | A | 9/2015 |
| CN | 204653805 | U | 9/2015 |
| JP | 2001270019 | A | 10/2001 |
| WO | WO-2012004603 | A1 | 1/2012 |

OTHER PUBLICATIONS

European Patent Office as the International Searching Authority, International Search Report and Written Opinion for International Application No. PCT/US2017/021754, dated Jun. 6, 2017.

* cited by examiner

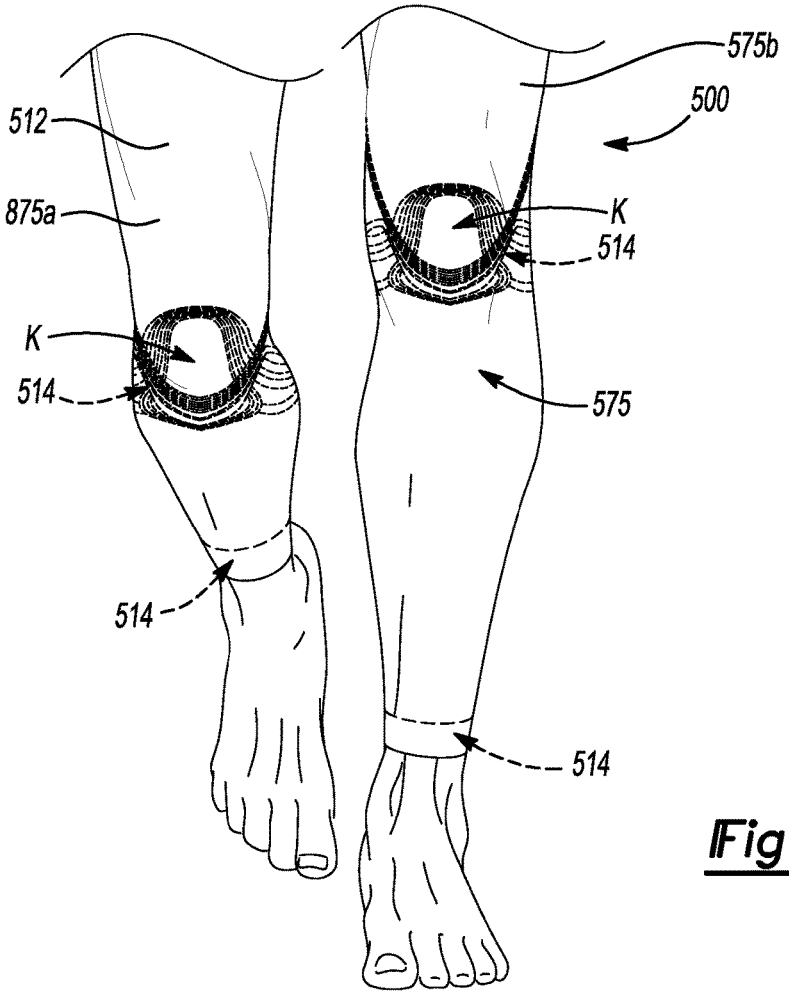
Fig-3C
Fig-4A
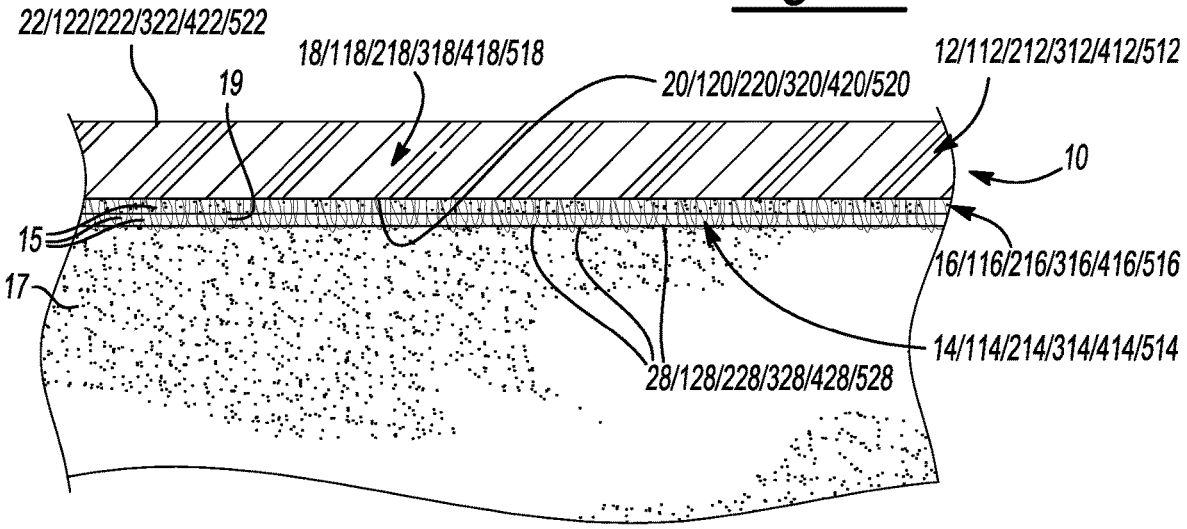

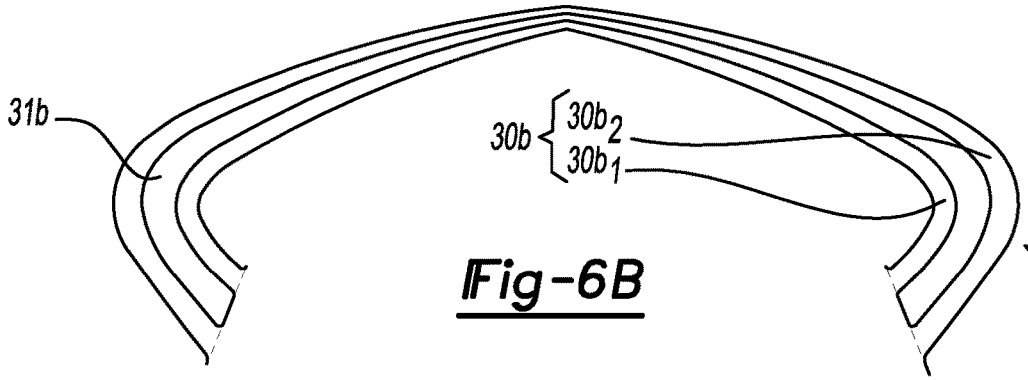
Fig-6B
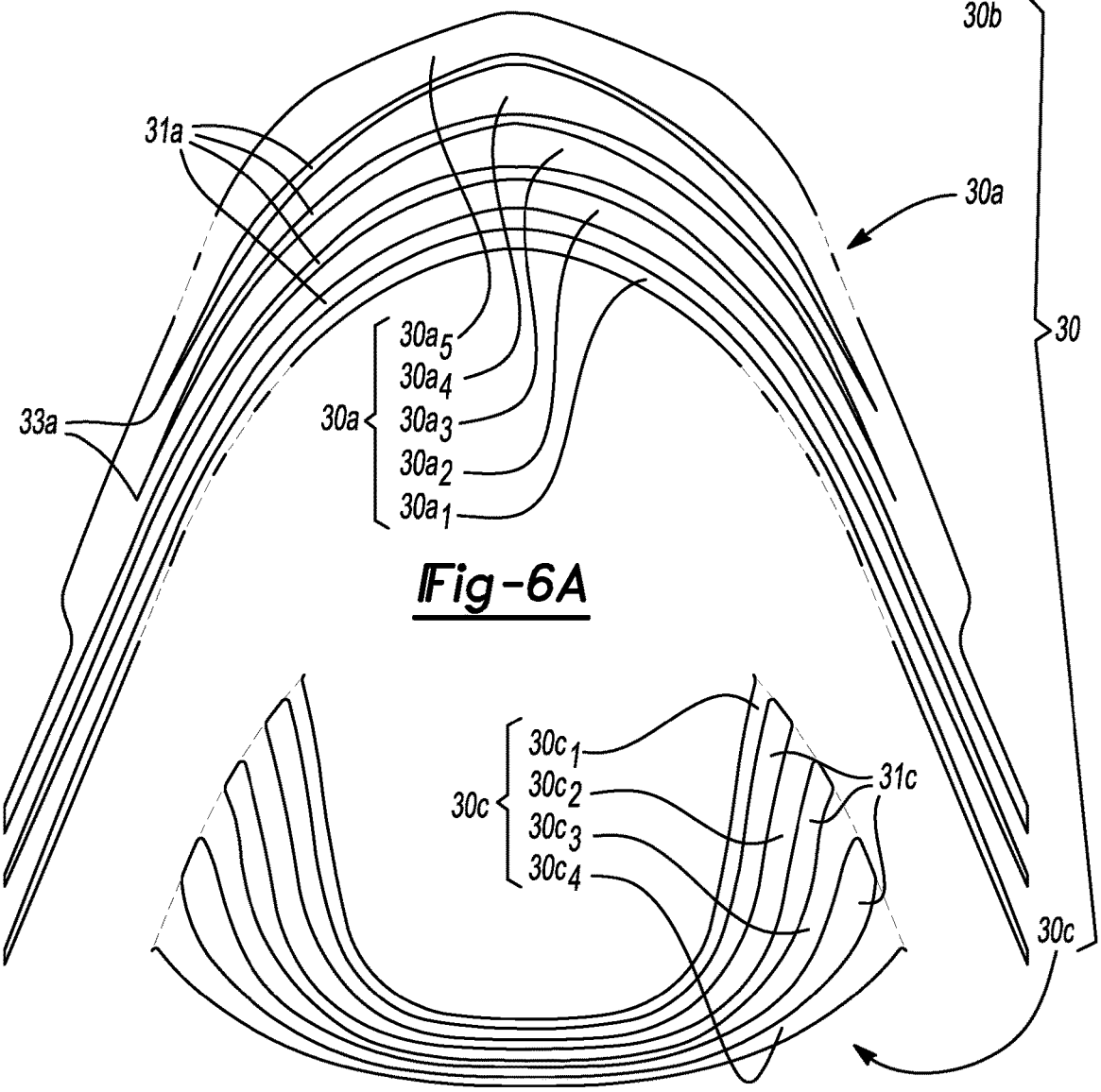
Fig-6A
Fig-6C

ARTICLE OF CLOTHING INCLUDING A SUBSTRATE MATERIAL AND A FLOCKING MATERIAL

CROSS REFERENCE TO RELATED APPLICATION

This application is a national phase of International Application Serial No. PCT/US2017/021754, filed Mar. 10, 2017, which claims priority to U.S. Provisional Application Ser. No. 62/306,319, filed Mar. 10, 2016, the disclosure of which are hereby incorporated by reference in their entirety.

FIELD

The present disclosure relates generally to an article of clothing including a substrate material and a flocking material that is sized as a shirt for arrangement about a torso of a wearer, or, alternatively, as a pair of pants for arrangement about a groin of the wearer.

BACKGROUND

This section provides background information related to the present disclosure and is not necessarily prior art.

Various articles of clothing are known in the art. In some instances, articles of clothing may be worn for stylistic purposes. In other situations, articles of clothing may provide protection from the elements (e.g., protection from ultraviolet rays of light from the sun). It some examples, articles of clothing may enhance an athletic experience (e.g., the article of clothing may conform to wearer's body thereby reducing wind resistance or drag).

In most applications, an article of clothing may include at least one material. The at least one material may yield one or more desired functions (e.g., promoting style, providing protection from the elements, and enhancing an athletic experience).

While known articles of clothing have proven acceptable for various applications, such conventional articles of clothing are nevertheless susceptible to improvements that may enhance their overall performance and cost. Therefore, a need exists for improved articles of clothing and methodologies for forming the same.

DRAWINGS

The drawings described herein are for illustrative purposes only of selected configurations and not all possible implementations, and are not intended to limit the scope of the present disclosure.

FIG. 3C is a front, enlarged portion of the pair of trousers of FIG. 3C;

FIG. 4A is a cross-sectional view of either of the first article of clothing or the second article of clothing according to line 4A-4A of FIG. 1B or 2B or 3B;

FIG. 6A is a plan view of a first group of line segments of the plurality of line segments of FIG. 5;

FIG. 6B is a plan view of a second group of line segments of the plurality of line segments of FIG. 5; and FIG. 6C is a plan view of a third group of line segments of the plurality of line segments of FIG. 5.

Corresponding reference numerals indicate corresponding parts throughout the drawings.

DETAILED DESCRIPTION

Figure 1A:
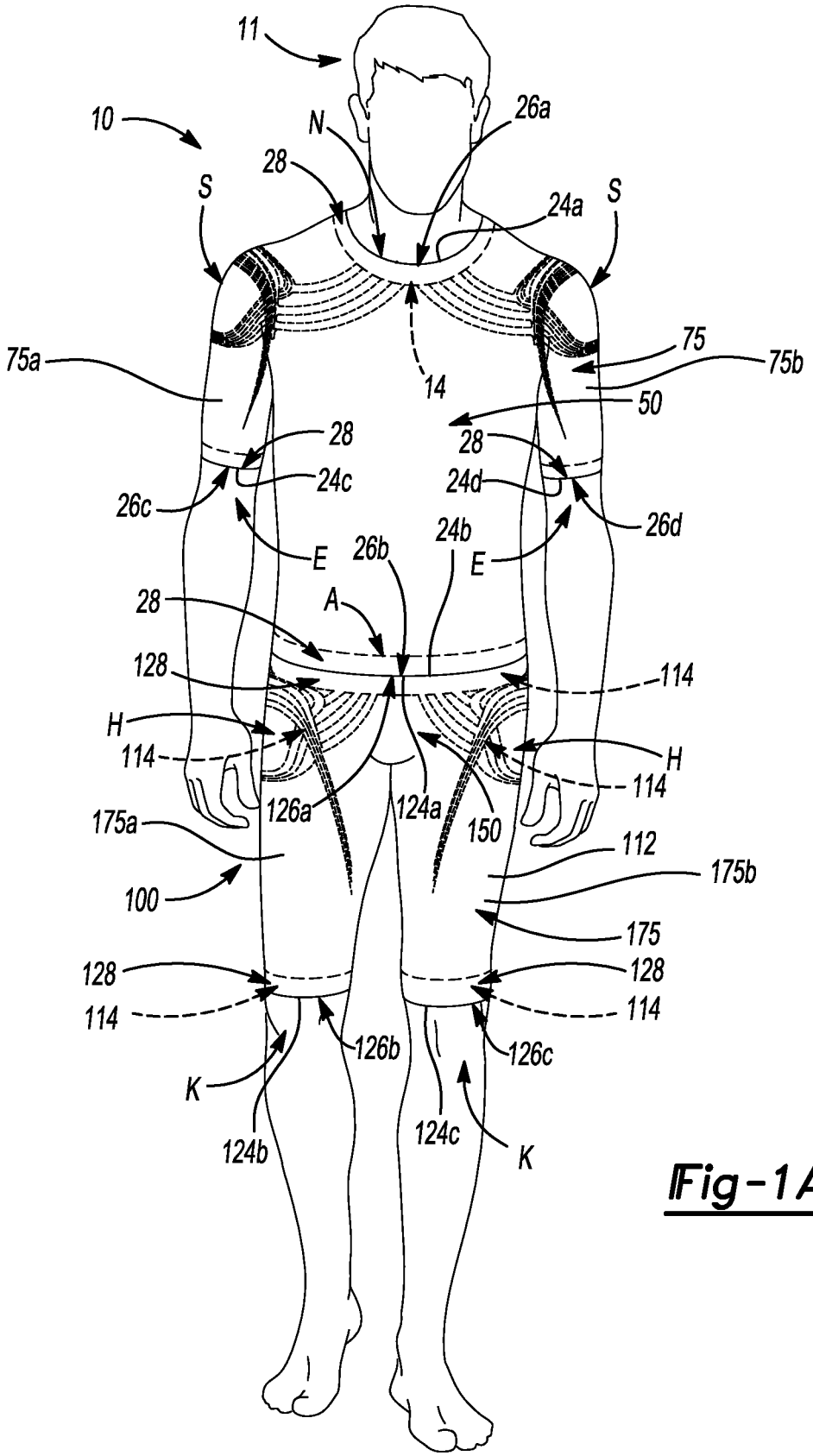
FIG. 1A is a front view of a first article of clothing, such as, for example, a short-sleeve shirt, and a second article of clothing, such as, for example, a pair of shorts, in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides an article of clothing sized as a shirt for arrangement about a torso of a wearer. The article of clothing may include a substrate material and a flocking material. The substrate material may include a base layer defined by an inner surface, an outer surface and a plurality of side surfaces that join the inner surface to the outer surface. The plurality of side surfaces may include four side surfaces defined by a first side surface, a second side surface, a third side surface and a fourth side surface. The base layer may form a plurality of openings. The plurality of openings in may include four openings defined by a first opening, a second opening, a third opening and a fourth opening. Each opening of the plurality of openings may be defined by the intersection of the inner surface and a side surface of the plurality of side surfaces. The first opening may be defined by an intersection of the inner surface and the first side surface. The second opening may be defined by an intersection of the inner surface and the second side surface. The third opening may be defined by an intersection of the inner surface and the third side surface. The fourth opening may be defined by an intersection of the inner surface and the fourth side surface. The base layer may be configured for defining a body-receiving portion and at least one limb-receiving portion extending from the body-receiving portion. The at least one limb-receiving portion may include a first sleeve portion and a second sleeve portion. The first opening may be formed by the body-receiving portion and may be sized for circumscribing a neck of the wearer. The second opening may be formed by the body-receiving portion and may be sized for circumscribing an abdominal region of the wearer. The third opening may be formed by the first sleeve portion and may be sized for circumscribing a right arm of the wearer. The fourth opening may be formed by the second sleeve portion and may be sized for circumscribing a left arm of a wearer. The flocking material may be arranged upon the inner surface of the base layer proximate at least one opening of the plurality of openings.

Implementations of the disclosure may include one or more of the following optional features. For example, the flocking material may be arranged upon the inner surface of the base layer at the at least one opening of the plurality of openings. The flocking material may be arranged upon the inner surface at a distance approximately equal to zero from the side surface.

In some implementations, the flocking material is arranged upon the inner surface of the base layer near the at least one opening of the plurality of openings. The flocking material may be arranged upon the inner surface at a distance approximately equal to but slightly greater than zero from the side surface.

In some implementations, the flocking material may be attached to the substrate material with an intermediate material.

In some examples, the intermediate material is an adhesive material.

In some implementations, both of the first sleeve portion and the second sleeve portion extend away from the body-receiving portion at a distance such that the article of clothing sized as the shirt for arrangement as about a torso of a wearer is a short-sleeve shirt. The first sleeve portion may extend away from the body-receiving portion at the distance such that the third opening formed by the first sleeve portion circumscribes the right arm of the wearer above a right elbow of the wearer. The second sleeve portion may extend away from the body-receiving portion at the distance such that the fourth opening formed by the second sleeve portion circumscribes the left arm of the wearer above a left elbow of the wearer. The flocking material may be arranged upon the inner surface of the base layer away from the at least one opening of the plurality of openings such that the flocking material is sized for arrangement upon the inner surface of the base layer about at least one joint or point of articulation of the wearer. The at least one joint or point of articulation of the wearer includes a left shoulder of the wearer and a right shoulder of the wearer.

In some examples, the flocking material may be defined by a pattern of a plurality of line segments that are connected in an intersecting relationship. One or more line segments of the plurality of line segments may define a substantially pentagonal shape that is sized for substantially circumscribing the at least one joint or point of articulation of the wearer.

In some implementations, both of the first sleeve portion and the second sleeve portion extend away from the body-receiving portion at a distance such that the article of clothing sized as the shirt for arrangement as about a torso of a wearer is an approximately three-quarter length sleeve shirt. The first sleeve portion may extend away from the body-receiving portion at the distance such that the third opening formed by the first sleeve portion circumscribes the right arm of the wearer slightly beyond a right elbow of the wearer. The second sleeve portion may extend away from the body-receiving portion at the distance such that the fourth opening formed by the second sleeve portion circumscribes the left arm of the wearer slightly beyond a left elbow of the wearer. The flocking material may be arranged upon the inner surface of the base layer away from the at least one opening of the plurality of openings such that the flocking material is sized for arrangement upon the inner surface of the base layer about at least one joint or point of articulation of the wearer. The at least one joint or point of articulation of the wearer may include a left shoulder of the wearer, a right shoulder of the wearer, the left elbow of the wearer and the right elbow of the wearer.

In some examples, the flocking material is defined by a pattern of a plurality of line segments that are connected in an intersecting relationship. One or more line segments of the plurality of line segments may define a substantially pentagonal shape that is sized for substantially circumscribing the at least one joint or point of articulation of the wearer.

In some implementations, both of the first sleeve portion and the second sleeve portion extend away from the body-receiving portion at a distance such that the article of clothing is a long sleeve shirt. The first sleeve portion may extend away from the body-receiving portion at the distance such that the third opening formed by the first sleeve portion circumscribes the right arm of the wearer beyond a right elbow of the wearer. The second sleeve portion may extend away from the body-receiving portion at the distance such that the fourth opening formed by the second sleeve portion circumscribes the left arm of the wearer beyond a left elbow of the wearer. The flocking material may be arranged upon the inner surface of the base layer away from the at least one opening of the plurality of openings such that the flocking material is sized for arrangement upon the inner surface of the base layer about at least one joint or point of articulation of the wearer. The at least one joint or point of articulation of the wearer may include a left shoulder of the wearer, a right shoulder of the wearer, the left elbow of the wearer and the right elbow of the wearer.

In some examples, the flocking material is defined by a pattern of a plurality of line segments that are connected in an intersecting relationship. One or more line segments of the plurality of line segments may define a substantially pentagonal shape that is sized for substantially circumscribing the at least one joint or point of articulation of the wearer.

Another aspect of the disclosure provides an article of clothing sized as a pair of pants for arrangement about a groin of a wearer. The article of clothing may include a substrate material and a flocking material. The substrate material may include a base layer defined by an inner surface, an outer surface and a plurality of side surfaces that join the inner surface to the outer surface. The plurality of side surfaces may include three side surfaces defined by a first side surface, a second side surface and a third side surface. The base layer may form a plurality of openings. The plurality of openings may include four openings defined by a first opening, a second opening and a third opening. Each opening of the plurality of openings may be defined by the intersection of the inner surface and a side surface of the plurality of side surfaces. The first opening may be defined by an intersection of the inner surface and the first side surface. The second opening is defined by an intersection of the inner surface and the second side surface. The third opening may be defined by an intersection of the inner surface and the third side surface. The base layer may be configured for defining a body-receiving portion and at least one limb-receiving portion extending from the body-receiving portion. The at least one limb-receiving portion may include a first sleeve portion and a second sleeve portion. The first opening may be formed by the body-receiving portion and may be sized for circumscribing a waist of the wearer. The second opening may be formed by the first sleeve portion and may be sized for circumscribing a right leg of the wearer. The third opening may be formed by the second sleeve portion and may be sized for circumscribing a left leg of a wearer. The flocking material may be arranged upon the inner surface of the base layer proximate at least one opening of the plurality of openings.

Implementations of the disclosure may include one or more of the following optional features. For example, the flocking material may be arranged upon the inner surface of the base layer at the at least one opening of the plurality of openings. The flocking material may be arranged upon the inner surface at a distance approximately equal to zero from the side surface.

In some implementations, the flocking material may be arranged upon the inner surface of the base layer near the at least one opening of the plurality of openings. The flocking material may be arranged upon the inner surface at a distance approximately equal to but slightly greater than zero from the side surface.

In some implementations, the flocking material may be attached to the substrate material with an intermediate material.

In some examples, the intermediate material is an adhesive material.

In some implementations, both of the first sleeve portion and the second sleeve portion extend away from the body-receiving portion at a distance such that the article of clothing sized as the pair of pants for arrangement as about a groin of a wearer is a pair of shorts. The first sleeve portion may extend away from the body-receiving portion at the distance such that the second opening formed by the first sleeve portion circumscribes the right leg of the wearer above a right knee of the wearer. The second sleeve portion may extend away from the body-receiving portion at the distance such that the third opening formed by the second sleeve portion circumscribes the left leg of the wearer above a left knee of the wearer. The flocking material may be arranged upon the inner surface of the base layer away from the at least one opening of the plurality of openings such that the flocking material is sized for arrangement upon the inner surface of the base layer about at least one joint or point of articulation of the wearer. The at least one joint or point of articulation of the wearer may include a left hip of the wearer and a right hip of the wearer.

In some examples, the flocking material may be defined by a pattern of a plurality of line segments that are connected in an intersecting relationship. One or more line segments of the plurality of line segments may define a substantially pentagonal shape that is sized for substantially circumscribing the at least one joint or point of articulation of the wearer.

In some implementations, both of the first sleeve portion and the second sleeve portion may extend away from the body-receiving portion at a distance such that the article of clothing is a pair of capris. The first sleeve portion may extend away from the body-receiving portion at the distance such that the second opening formed by the first sleeve portion circumscribes the right leg of the wearer slightly beyond a right knee of the wearer. The second sleeve portion may extend away from the body-receiving portion at the distance such that the third opening formed by the second sleeve portion circumscribes the left leg of the wearer slightly beyond a left knee of the wearer. The flocking material may be arranged upon the inner surface of the base layer away from the at least one opening of the plurality of openings such that the flocking material is sized for arrangement upon the inner surface of the base layer about at least one joint or point of articulation of the wearer. The at least one joint or point of articulation of the wearer may include a left hip of the wearer, a right hip of the wearer, the left knee of the wearer and the right knee of the wearer.

In some examples, the flocking material may be defined by a pattern of a plurality of line segments that are connected in an intersecting relationship. One or more line segments of the plurality of line segments may define a substantially pentagonal shape that is sized for substantially circumscribing the at least one joint or point of articulation of the wearer.

In some implementations, both of the first sleeve portion and the second sleeve portion extend away from the body-receiving portion at a distance such that the article of clothing sized as the pair of pants for arrangement as about a groin of a wearer is a pair of trousers. The first sleeve portion may extend away from the body-receiving portion at the distance such that the second opening formed by the first sleeve portion circumscribes the right leg of the wearer beyond a right knee of the wearer. The second sleeve portion may extend away from the body-receiving portion at the distance such that the third opening formed by the second sleeve portion circumscribes the left leg of the wearer beyond a left knee of the wearer. The flocking material may be arranged upon the inner surface of the base layer away from the at least one opening of the plurality of openings such that the flocking material is sized for arrangement upon the inner surface of the base layer about at least one joint or point of articulation of the wearer. The at least one joint or point of articulation of the wearer may include a left hip of the wearer, a right hip of the wearer, the left knee of the wearer and the right knee of the wearer.

In some examples, the flocking material is defined by a pattern of a plurality of line segments that are connected in an intersecting relationship. One or more line segments of the plurality of line segments may define a substantially pentagonal shape that is sized for substantially circumscribing the at least one joint or point of articulation of the wearer.

Figure 1B:
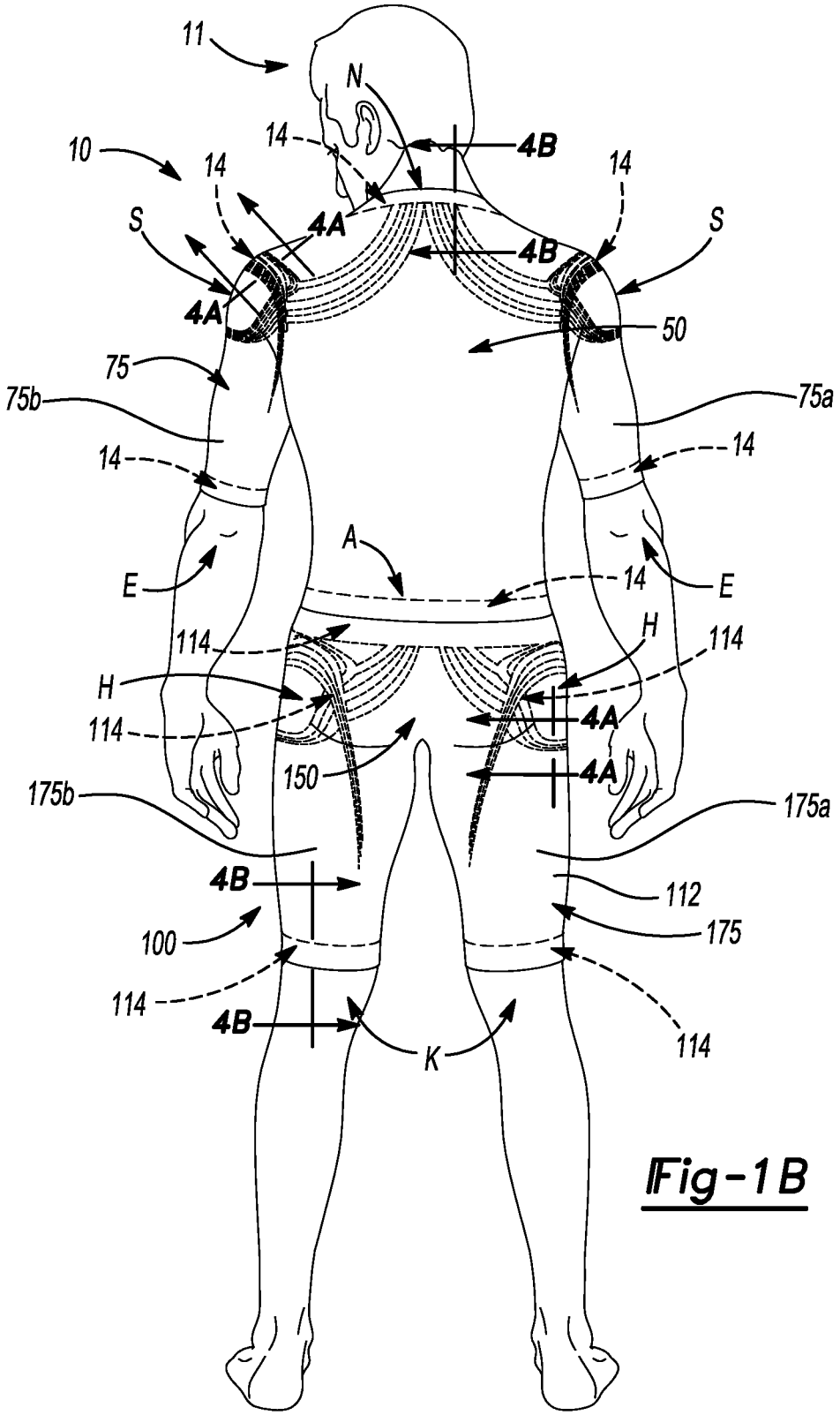
FIG. 1B is a rear view of the first article of clothing and the second article of clothing of FIG. 1A.

Referring to FIGS. 1A-1B, an article of clothing is shown generally at 10. The article of clothing 10 may be worn by a wearer 11 for utilization in any number of athletic activities including, but not limited to surfing, skiing and bicycling. In this regard, in some implementations, the article of clothing 10 may include a wetsuit or portion thereof. The article of clothing 10 may include a substrate material 12 and a flocking material 14.

The flocking material 14 may include a plurality of small fiber particles 15 (i.e., flock), as illustrated in FIG. 4A. In a worn state (e.g., FIGS. 1A and 1B), the article of clothing 10 may be worn by the wearer 11 such that the substrate material 12 and/or the flocking material 14 engages the wearer 11. For example, as illustrated in FIG. 4A, the flocking material 14 may engage a wearer's skin 17. In this regard, the flocking material 14 may enhance the substrate material 12 in terms of tactile sensation (e.g., the flocking material 14 may provide a soft and comfortable feel), aesthetics, color and appearance while providing insulation and slip-or-grip friction to the substrate material 12. Such use of flocking material 14 may be well-suited for use in wet conditions. For example, the flocking material 14 may be disposed as a primary or base layer of clothing under a wetsuit formed by substrate material 12. In this regard, as illustrated in FIG. 4A, the flocking material 14 may permit fluid (e.g., water, air, etc.) to flow in a gap 19 defined by and between the wearer's skin 17 and the substrate material 12.

Figure 4B:
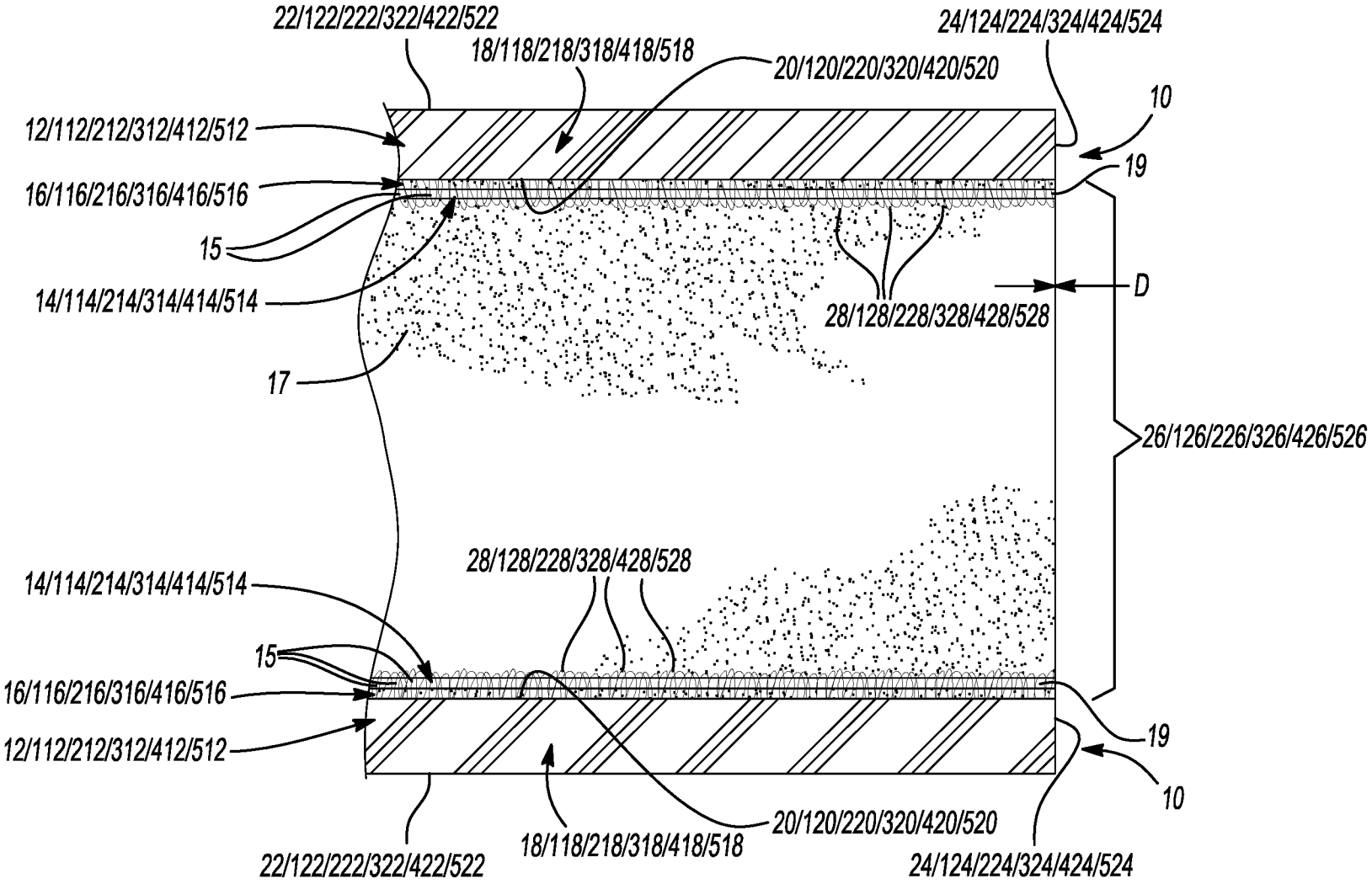
FIG. 4B is a cross-sectional view of either of the first article of clothing or the second article of clothing according to line 4B-4B of FIG. 1B or 2B or 3B.

Referring to FIGS. 4A-4B, in some instances, the flocking material 14 may be attached to the substrate material 12 with an intervening material 16 such as an adhesive, for example. In other examples, the flocking material 14 may be coupled to the substrate material 12 without the use of the intervening material 16.

Referring to FIGS. 4A-4B, the substrate material 12 may include a base layer 18 having an inner surface 20, an outer surface 22, and plurality of side surfaces 24. Referring to FIG. 4B, the inner surface 20 may oppose the outer surface 22 such that the plurality of side surfaces 24 join the inner surface 20 to the outer surface 22. In an example, as seen in FIG. 1A, the plurality of side surfaces 24 include a first side surface 24*a*, a second side surface 24*b*, a third side surface 24*c* and a fourth side surface 24*d*.

Referring to FIG. 4B, the base layer 18 forms a plurality of openings 26 through which a portion (e.g., arm, leg, waist, neck) of the wearer 11 may extend. Referring to FIG. 1A, in an example, the plurality of openings 26 include a first opening 26*a*, a second opening 26*b*, a third opening 26*c* and a fourth opening 26*d*. Referring to FIG. 4B, each opening 26*a*-26*d* of the plurality of openings 26 may be defined by the intersection of the inner surface 20 and a side surface 24*a*-24*d* of the plurality of side surfaces 24. For example, (1) the first opening 26*a* may be defined by the intersection of the inner surface 20 and the first side surface 24*a*; (2) the second opening 26*b* may be defined by the intersection of the inner surface 20 and the second side surface 24*b*; (3) the third opening 26*c* may be defined by the intersection of the inner surface 20 and the third side surface 24*c*; and (4) the fourth opening 26*d* may be defined by the intersection of the inner surface 20 and the fourth side surface 24*d*.

Referring to FIG. 1A, the base layer 18 may include a body-receiving portion 50 and at least one limb-receiving portion 75 (e.g., a sleeve) extending from the body-receiving portion 50. In some implementations, the at least one limb-receiving portion 75 includes a first sleeve portion 75*a* and a second sleeve portion 75*b*.

The body-receiving portion 50 is sized for arrangement about a torso T of the wearer 11. The first sleeve portion 75*a* is sized for arrangement about a right arm of the wearer 11. The second sleeve portion 75*b* is sized for arrangement about a left arm of the wearer 11. Collectively, the body-receiving portion 50, the first sleeve portion 75*a*, and the second sleeve portion 75*b* are sized for use as a shirt (such as, e.g., a short-sleeve shirt).

The first opening 26*a* is formed by the body-receiving portion 50 and is sized for circumscribing a neck N of the wearer 11. The second opening 26*b* is formed by the body-receiving portion 50 and is sized for circumscribing an abdominal region A (e.g., a region generally bounded by the diaphragm and pelvis) of the wearer 11. The third opening 26*c* is formed by the first sleeve portion 75*a* and is sized for circumscribing a right arm of the wearer 11 above the right elbow E (e.g., at approximately about a bicep region) of the wearer 11. The fourth opening 26*d* is formed by the second sleeve portion 75*b* and is sized for circumscribing a left arm of the wearer 11 above the left elbow E (e.g., at approximately about a bicep region) of the wearer 11.

Referring to FIGS. 4A-4B, the flocking material 14 may be attached to the inner surface 20 of the base layer 18. In some examples, as seen in FIG. 4B, the flocking material 14 is arranged upon the inner surface 20 of the base layer 18 at the opening 26*a*, 26*b*, 26*c*, 26*d* (i.e., the flocking material 14 is arranged at a distance D approximately equal to zero from the side surface 24*a*, 24*b*, 24*c*, 24*d*). In some instances, the flocking material 14 may be arranged upon the inner surface 20 of the base layer 18 near the opening 26*a*, 26*b*, 26*c*, 26*d* (i.e., the flocking material 14 is arranged at a distance D approximately equal to but slightly greater than zero from the side surface 24*a*, 24*b*, 24*c*, 24*d*).

In implementations where the flocking material 14 is arranged at or near the opening 26*a*, 26*b*, 26*c*, 26*d*, the flocking material 14, including the fiber particles 15, may be arranged in the form of a loop 28 or a plurality of segments forming an interrupted loop 28. The loop 28 or plurality of segments forming the interrupted loop 28 may directly oppose the wearer's skin 17 to provide a soft or comfortable feel while concurrently restricting movement (e.g., sliding) of the article of clothing 10 about the plurality of openings 26 in order to retain the article of clothing 10 to the wearer 11.

In other examples, as seen in FIGS. 1A and 4A, the flocking material 14 is arranged upon the inner surface 20 of the base layer 18 away from the plurality of openings 26; in such instances, the flocking material 14 is selectively sized for arrangement about joints or points of articulation (e.g., a left shoulder region S and a right shoulder region S) of the wearer. Referring to FIGS. 5 and 6A-6C, when the flocking material 14 is selectively sized for arrangement about joints or points of articulation of a wearer, the flocking material 14 may be arranged in the form of a pattern of a plurality of line segments 30 that are connected in an intersecting relationship. For example, the flocking material 14 may be disposed between, and bounded by, a plurality of the line segments 30. The plurality of line segments 30 may include a first group of line segments 30*a* (see also, e.g., FIG. 6A), a second group of line segments 30*b*, (see also, e.g., FIG. 6B) and a third group of line segments 30*c* (see also, e.g., FIG. 6C).

The first group of line segments 30*a* may include an array of downwardly U-shaped line segments. In an example, the first group of line segments 30*a* includes a first (inner-most) line segment $\mathbf{30}a_1$, a second line segment $\mathbf{30}a_2$, a third line segment $\mathbf{30}a_3$, a fourth line segment $\mathbf{30}a_4$ and a fifth (outer-most) line segment $\mathbf{30}a_5$ that may be concentric with one another. Each line segment 30*a* of the first group of line segments 30*a* may be substantially parallel (+/− 5 degrees) to one or more of the other line segments 30*a* along at least a portion of a length of the line segment 30*a*, such that the array of line segments 30*a* defines a plurality of gaps 31*a* (e.g., areas in which the flocking material 14 is not disposed) between consecutive line segments 30*a* and a plurality of intersections 33*a* (e.g., locations at which one of the line segments 30*a* intersects another of the line segments 30*a*) of consecutive line segments 30*a*.

The second group of line segments 30*b*, may include an array of downwardly U-shaped, non-intersecting line segments. In an example, the second group of line segments 30*b*, includes a first (inner-most) line segment $\mathbf{30}b_1$ and a second (outermost) line segment $\mathbf{30}b_2$ that may be concentric with one another. The first line segment $\mathbf{30}b_1$ may be substantially parallel (+/− 5 degrees) to the second line segment $\mathbf{30}b_2$ along at least a portion of a length of the first line segment $\mathbf{30}b_1$, such that the array of line segments 30*b*, defines a plurality of gaps 31*b* (e.g., areas in which the flocking material 14 is not disposed) between consecutive line segments 30*b*.

The third group of line segments 30*c* includes an array of upwardly U-shaped, non-intersecting line segments. In an example, the third group of line segments 30*c* includes a first (inner-most) line segment $\mathbf{30}c_1$, a second line segment $\mathbf{30}c_2$, a third line segment $\mathbf{30}c_3$ and a fourth (outer-most) line segment $\mathbf{30}c_4$ that may be concentric with one another and with the line segments $\mathbf{30}a_1$, $\mathbf{30}a_2$, $\mathbf{30}a_3$, $\mathbf{30}a_4$, $\mathbf{30}a_5$ of the first group of line segments 30*a* and/or the line segments $\mathbf{30}b_1$, $\mathbf{30}b_2$ of the second group of line segments 30*b*. Each line segment 30*c* of the first group of line segments 30*c* may be substantially parallel (+/− 5 degrees) to one or more of the other line segments 30*c* along at least a portion of a length of the line segment 30*c*, such that the array of line segments 30*c* defines a plurality of gaps 31*c* (e.g., areas in which the flocking material 14 is not disposed) between consecutive line segments 30*c*.

Figure 5:
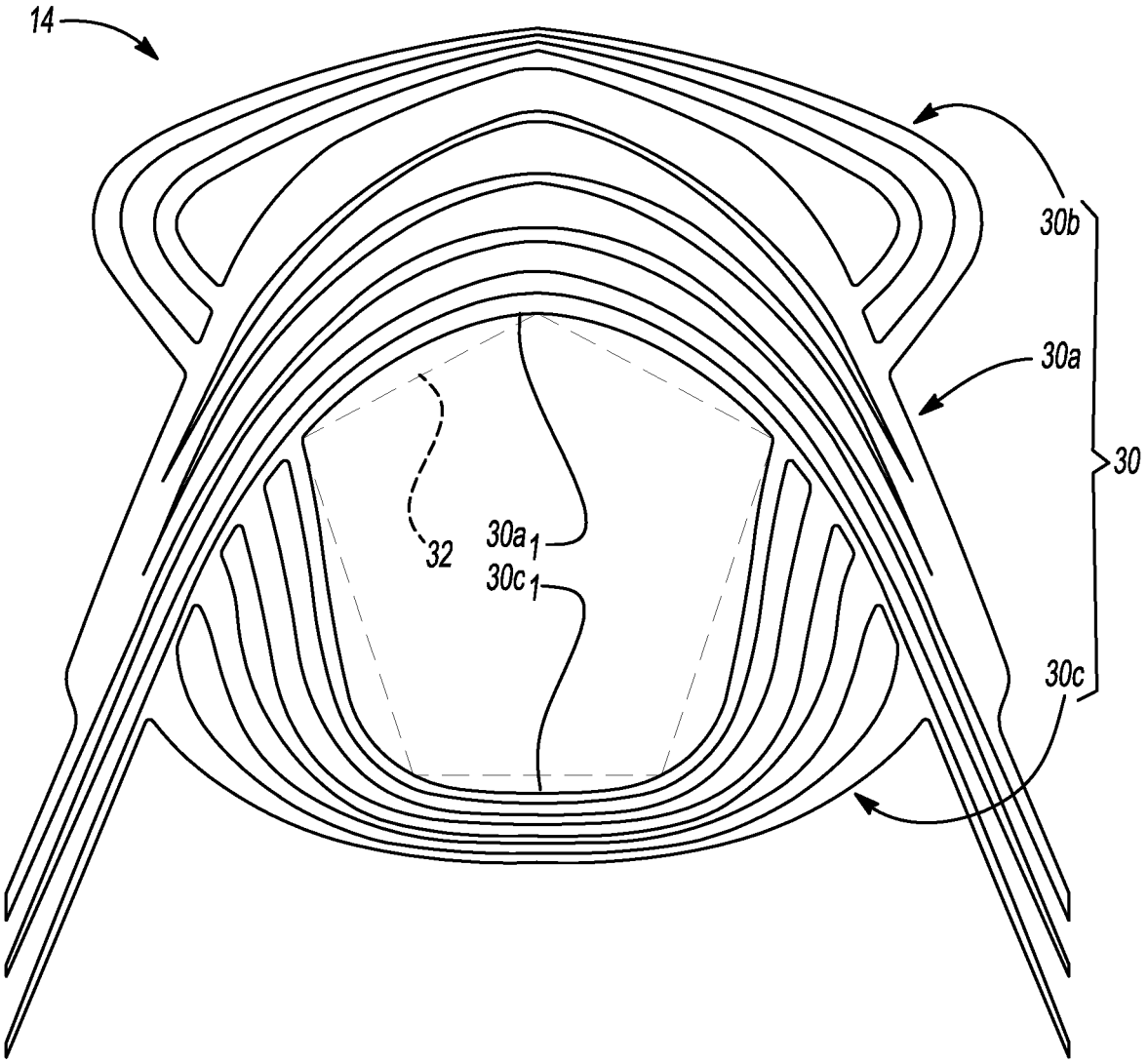
FIG. 5 is a plan view of a pattern of a plurality of line segments of flocking material of either of the first article of clothing or the second article of clothing of FIGS. 1A-3B.

As seen in FIG. 5, when the plurality of line segments 30 are connected in an intersecting relationship, the first group of line segments 30*a* may join one or more portions of the second group of line segments 30*b*, to the third group of line segments 30*c*. Furthermore, a portion of a length of the inner-most line segment $\mathbf{30}a_1$ of the first group of line segments 30*a* including an array of downwardly U-shaped, non-intersecting and intersecting line segments and a portion of a length of the inner-most line segment $\mathbf{30}c_1$ of the third group of line segments 30*c* including an array of upwardly U-shaped, non-intersecting line segments may define a generally pentagonally-shaped gap or opening 32 (see dashed line) that is sized for substantially circumscribing a joint or point of articulation region of the wearer. While the gap 32 is described and shown as having a similar shape as a pentagon, the gap 32 could include a different shape such as, for example, a circular shape. The plurality of line segments 30 defined by the flocking material 14 may directly oppose the wearer's skin 17 to provide a soft or comfortable feel while concurrently restricting movement (e.g., sliding) of the article of clothing 10 about the joint or point of articulation region of the wearer in order to retain the article of clothing 10 about the joint or point of articulation region of the wearer.

Referring to FIGS. 1A-1B, an article of clothing is shown generally at 100. The article of clothing 100 may be worn by the wearer 11 for utilization in any number of athletic activities including, but not limited to surfing, skiing and bicycling. In this regard, in some implementations, the article of clothing 100 may include a wetsuit or portion thereof. The article of clothing 100 may include a substrate material 112 and a flocking material 114.

The flocking material 114 may include the plurality of small fiber particles 15 (i.e., flock), as illustrated in FIG. 4A. In the worn state (e.g., FIGS. 1A and 1B), the article of clothing 100 may be worn by the wearer 11 such that the substrate material 112 and/or the flocking material 114 engages the wearer 11. For example, as illustrated in FIG. 4A, the flocking material 14 may engage the wearer's skin 17. In this regard, the flocking material 114 may enhance the substrate material 112 in terms of tactile sensation (e.g., the flocking material 114 may provide a soft and comfortable feel), aesthetics, color and appearance while providing insulation and slip-or-grip friction to the substrate material 112. Such use of flocking material 114 may be well-suited for use in wet conditions. For example, the flocking material 114 may be disposed as a primary or base layer of clothing under a wetsuit formed by the substrate material 12. In this regard, as illustrated in FIG. 4A, the flocking material 114 may permit fluid (e.g., water, air, etc.) to flow between the wearer's skin 17 and the substrate material 12.

Referring to FIGS. 4A-4B, in some instances, the flocking material 114 may be attached to the substrate material 112 with, an intervening material 116, such as an adhesive. In other examples, the flocking material 114 may be coupled to the substrate material 112 without the use of the intervening material 116.

Referring to FIGS. 4A-4B, the substrate material 112 may include a base layer 118 having an inner surface 120, an outer surface 122, and a plurality of side surfaces 124. Referring to FIG. 4B, the inner surface 120 may oppose the outer surface 122 such that the plurality of side surfaces 124 join the inner surface 120 to the outer surface 122. In an example, seen in FIG. 1A, the plurality of side surfaces 124 include a first side surface 124*a*, a second side surface 12*b* and a third side surface 124*c*.

Referring to FIG. 4B, the base layer 118 forms a plurality of openings 126 through which a portion (e.g., arm, leg, waist, neck) of the wearer 11 may extend. Referring to FIG. 1A, in an example, the plurality of openings 126 include a first opening 126*a*, a second opening 126*b* and a third opening 126*c*. Referring to FIG. 4B, each opening 126*a*-126*c* of the plurality of openings 126 may be defined by the intersection of the inner surface 120 and a side surface 124*a*-124*c* of the plurality of side surfaces 124. For example, (1) the first opening 126*a* may be defined by the intersection of the inner surface 120 and the first side surface 124*a*; (2) the second opening 126*b* may be defined by the intersection of the inner surface 120 and the second side surface 124*b*; and (3) the third opening 126*c* may be defined by the intersection of the inner surface 120 and the third side surface 124*c*.

Referring to FIG. 1A, the base layer 118 may include a body-receiving portion 150 and at least one limb-receiving portion 175 (e.g., a leg-receiving portion) extending from the body-receiving portion 150. The at least one limb-receiving portion 175 may include a first sleeve portion 175*a* and a second sleeve portion 175*b*.

The body-receiving portion 150 is sized for arrangement about a waist or groin of the wearer 11. The first sleeve portion 175*a* is sized for arrangement about a right leg of the wearer 11. The second sleeve portion 175*b* is sized for arrangement about a left leg of the wearer 11. Collectively, the body-receiving portion 150, the first sleeve portion 175*a* and the second sleeve portion 175*b* are sized for use as a pair of pants (such as, e.g., a pair of shorts).

The first opening 126*a* is formed by the body-receiving portion 150 and is sized for circumscribing a waist region (e.g., a region generally below the ribs and above the hips H) of the wearer 11. The second opening 126*b* is formed by the first sleeve portion 175*a* and is sized for circumscribing a right leg of the wearer 11 above the right knee K (e.g., at approximately about a thigh region) of the wearer 11. The third opening 126*c* is formed by the second sleeve portion 175*b* and is sized for circumscribing a left leg of the wearer 11 above the left knee K (e.g., at approximately about a thigh region) of the wearer 11.

Referring to FIGS. 4A-4B, the flocking material 114 may be attached to the inner surface 120 of the base layer 118. In some examples, as seen in FIG. 4B, the flocking material 114 is arranged upon the inner surface 120 of the base layer 118 at the opening 126*a*, 126*b*, 126*c* (i.e., the flocking material 114 is arranged at a distance D approximately equal to zero from the side surface 124*a*, 124*b*, 124*c*). In some instances, the flocking material 114 may be arranged upon the inner surface 120 of the base layer 118 near the opening 126*a*, 126*b*, 126*c* (i.e., the flocking material 114 is arranged at a distance D approximately equal to but slightly greater than zero from the side surface 124*a*, 124*b*, 124*c*).

In implementations where the flocking material 114 is arranged at or near the opening 126*a*, 126*b*, 126*c*, the flocking material 114, including the fiber particles 15, may be arranged in the form of a loop 128 or a plurality of segments forming an interrupted loop 128. The loop 128 or plurality of segments forming the interrupted loop 128 may directly oppose the wearer's skin 17 to provide a soft or comfortable feel while concurrently restricting movement (e.g., sliding) of the article of clothing 100 about the plurality of openings 126 in order to retain the article of clothing 100 to the wearer 11.

In other examples, as seen in FIGS. 1A and 4A, the flocking material 114 is arranged upon the inner surface 120 of the base layer 118 away from the plurality of openings 126. In such instances, the flocking material 114 is selectively sized for arrangement about joints or points of articulation (e.g., a left hip region H and a right hip region H) of the wearer 11. Referring to FIGS. 5 and 6A-6C, when the flocking material 114 is selectively sized for arrangement about joints or points of articulation of the wearer 11, the flocking material 114 may be arranged in the form of a pattern of a plurality of line segments 30 that are connected in an intersecting relationship. For example, the flocking material 114 may be disposed between, and bounded by, a plurality of the line segments 30. The plurality of line segments 30 may include the first group of line segments 30*a* (see also, e.g., FIG. 6A), the second group of line segments 30*b*, (see also, e.g., FIG. 6B) and the third group of line segments 30*c* (see also, e.g., FIG. 6C).

Figure 2A:
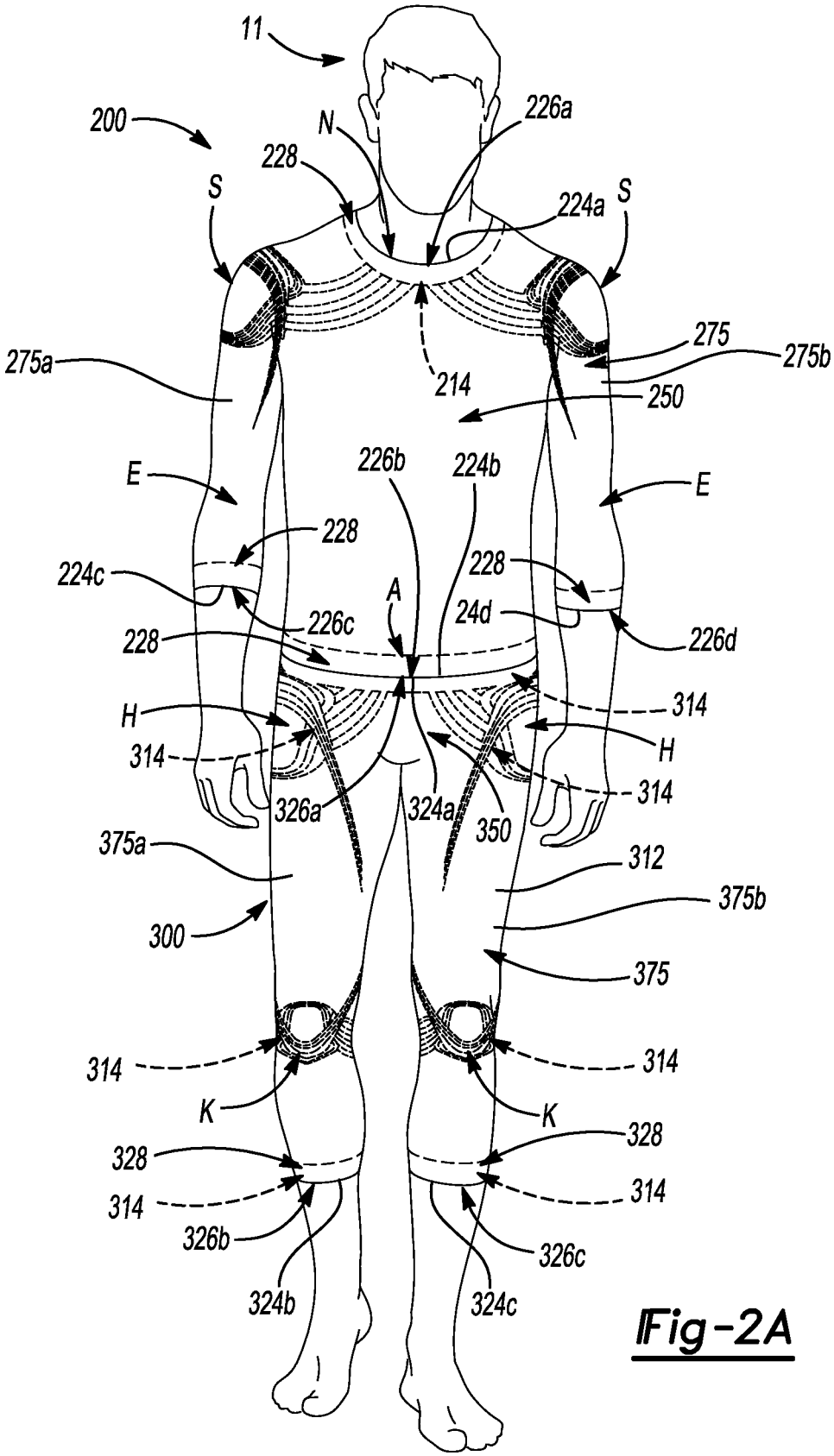
FIG. 2A is a front view of a first article of clothing, such as, for example, an approximately three-quarter length sleeve shirt, and a second article of clothing, such as, for example, a pair of capris in accordance with the principles of the present disclosure.
Figure 2B:
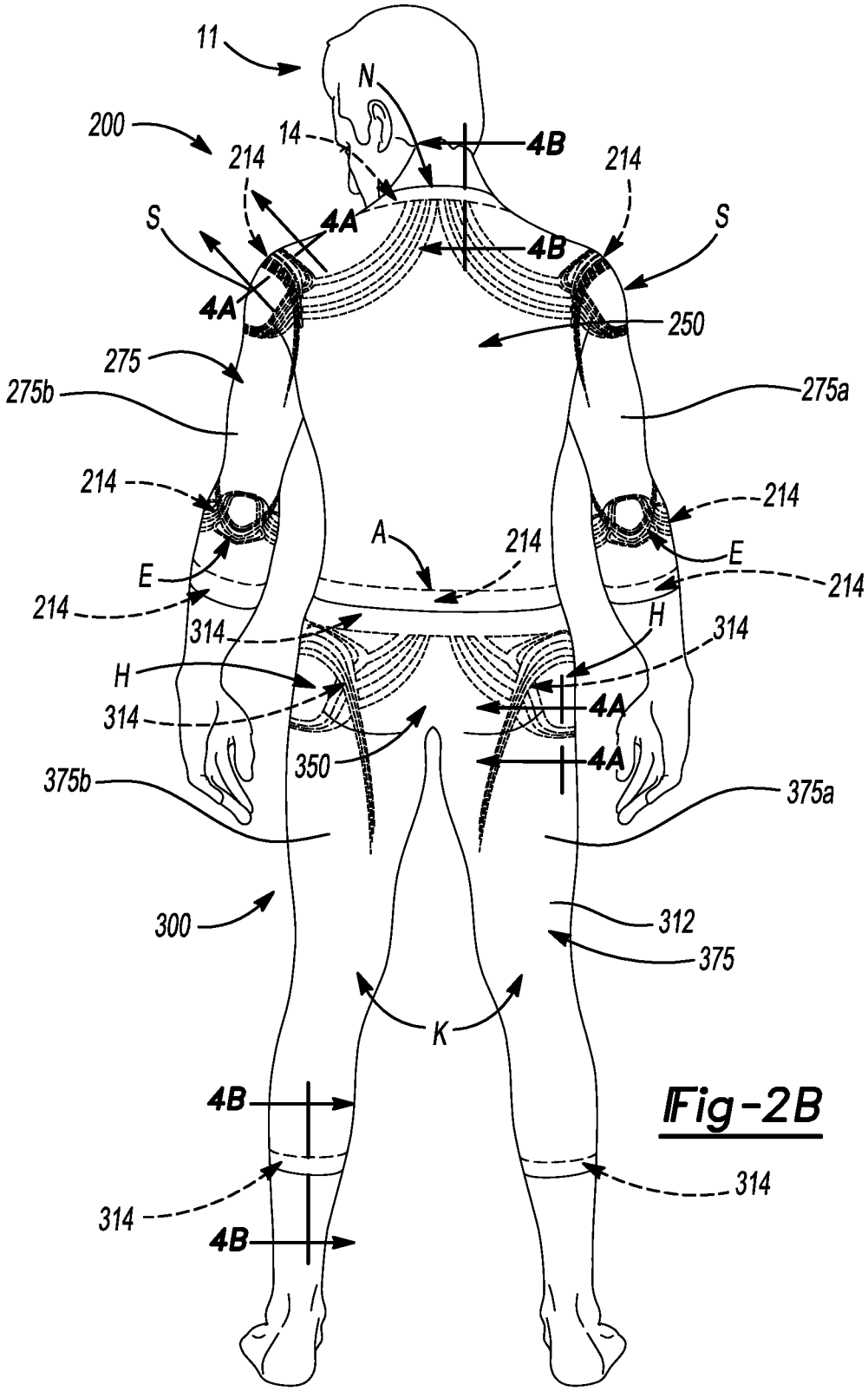
FIG. 2B is a rear view of the first article of clothing and the second article of clothing of FIG. 2A.

Referring to FIGS. 2A-2B, an article of clothing is shown generally at 200. The article of clothing 200 may be worn by the wearer 11 for utilization in any number of athletic activities including, but not limited to surfing, skiing and bicycling. In this regard, in some implementations, the article of clothing 200 may include a wetsuit or portion thereof. The article of clothing 200 may include a substrate material 212 and a flocking material 214.

The flocking material 214 may include a plurality of the small fiber particles 15 (i.e., flock), as illustrated in FIG. 4A. In the worn state (e.g., FIGS. 2A and 2B), the article of clothing 200 may be worn by the wearer 11 such that the substrate material 212 and/or the flocking material 214 engages the wearer 11. For example, as illustrated in FIG. 4A, the flocking material 214 may engage the wearer's skin 17. In this regard, the flocking material 214 may enhance the substrate material 212 in terms of tactile sensation (e.g., the flocking material 214 may provide a soft and comfortable feel), aesthetics, color and appearance while providing insulation and slip-or-grip friction to the substrate material 212. Such use of flocking material 214 may be well-suited for use in wet conditions. For example, the flocking material 214 may be disposed as a primary or base layer of clothing under a wetsuit formed by the substrate material 212. In this regard, as illustrated in FIG. 4A, the flocking material 214 may permit fluid (e.g., water, air, etc.) to flow in the gap 19 defined by between a wearer's skin 17 and the substrate material 212.

Referring to FIGS. 4A-4B, in some instances, the flocking material 214 may be attached to the substrate material 212 with an intervening material 16 such as an adhesive, for example. In other examples, the flocking material 214 may be coupled to the substrate material 212 without the use of the intervening material 16.

Referring to FIGS. 4A-4B, the substrate material 212 may include a base layer 218 having an inner surface 220, an outer surface 222, and a plurality of side surface 224. Referring to FIG. 4B, the inner surface 220 may oppose the outer surface 222 such that the plurality of side surfaces 224 join the inner surface 220 to the outer surface 222. In an example, seen in FIG. 2A, the plurality of side surfaces 224 include a first side surface 224*a*, a second side surface 224*b*, a third side surface 224*c* and a fourth side surface 224*d*.

Referring to FIG. 4B, the base layer 218 forms a plurality of openings 226 through which a portion (e.g., arm, leg, waist, neck) of the wearer 11 may extend. Referring to FIG. 2A, in an example, the plurality of openings 226 include a first opening 226*a*, a second opening 226*b*, a third opening 226*c* and a fourth opening 226*d*. Referring to FIG. 4B, each opening 226*a*-226*d* of the plurality of openings 226 may be defined by the intersection of the inner surface 220 and a side surface 224*a*-224*d* of the plurality of side surfaces 224. For example, (1) the first opening 226*a* may be defined by the intersection of the inner surface 220 and the first side surface 224*a*; (2) the second opening 226*b* may be defined by the intersection of the inner surface 220 and the second side surface 224*b*; (3) the third opening 226*c* may be defined by the intersection of the inner surface 220 and the third side surface 224*c*; and (4) the fourth opening 226*d* may be defined by the intersection of the inner surface 220 and the fourth side surface 224*d*.

Referring to FIG. 2A, the base layer 218 may include a body-receiving portion 250 and at least one limb-receiving portion 275 extending from the body-receiving portion 250. In some implementations, the at least one limb-receiving portion 275 includes a first sleeve portion 275*a* and a second sleeve portion 275*b*.

The body-receiving portion 250 is sized for arrangement about a torso of the wearer 11. The first sleeve portion 275*a* is sized for arrangement about a right arm of the wearer 11. The second sleeve portion 275*b* is sized for arrangement about a left arm of the wearer 11. Collectively, the body-receiving portion 250, the first sleeve portion 275*a* and the second sleeve portion 275*b* are sized for use as a shirt (such as, e.g., an approximately three-quarter length sleeve shirt).

The first opening 226*a* is formed by the body-receiving portion 250 and is sized for circumscribing a neck N of the wearer 11. The second opening 226*b* is formed by the body-receiving portion 250 and is sized for circumscribing an abdominal region A (e.g., a region generally bounded by the diaphragm and pelvis) of the wearer 11. The third opening 226*c* is formed by the first sleeve portion 275*a* and is sized for circumscribing a right arm of the wearer 11 slightly beyond the right elbow E (e.g., at approximately about a forearm region) of the wearer. The fourth opening 226*d* is formed by the second sleeve portion 275*b* and is sized for circumscribing a left arm of the wearer 11 slightly beyond the left elbow E (e.g., at approximately about a forearm region) of the wearer 11.

Referring to FIGS. 4A-4B, the flocking material 214 may be attached to the inner surface 220 of the base layer 218. In some examples, as seen in FIG. 4B, the flocking material 214 is arranged upon the inner surface 220 of the base layer 218 at the opening 226*a*, 226*b*, 226*c*, 226*d* (i.e., the flocking material 214 is arranged at a distance D approximately equal to zero from the side surface 224*a*, 224*b*, 224*c*, 224*d*). In some instances, the flocking material 214 may be arranged upon the inner surface 220 of the base layer 218 near the opening 226*a*, 226*b*, 226*c*, 226*d* (i.e., the flocking material 214 is arranged at a distance D approximately equal to but slightly greater than zero from the side surface 224*a*, 224*b*, 224*c*, 224*d*).

In implementations where the flocking material 214 is arranged at or near the opening 226*a*, 226*b*, 226*c*, 226*d*, the flocking material 214, including the fiber particles 15, may be arranged in the form of a loop 228 or a plurality of segments forming an interrupted loop 228. The loop 228 or plurality of segments forming the interrupted loop 228 may directly oppose the wearer's skin 17 to provide a soft or comfortable feel while concurrently restricting movement (e.g., sliding) of the article of clothing 200 about the plurality of openings 226 in order to retain the article of clothing 200 to the wearer 11.

In other examples, as seen in FIGS. 2A and 4A, the flocking material 214 is arranged upon the inner surface 220 of the base layer 218 away from the plurality of openings 226; in such instances, the flocking material 214 is selectively sized for arrangement about joints or points of articulation (e.g., a left shoulder region S, a right shoulder region S, a left elbow region E and a right elbow region E) of the wearer. Referring to FIGS. 5 and 6A-6C, when the flocking material 214 is selectively sized for arrangement about joints or points of articulation of a wearer, the flocking material 214 may be arranged in the form of a pattern of a plurality of line segments 30 that are connected in an intersecting relationship. For example, the flocking material 214 may be disposed between, and bounded by, a plurality of the line segments 30. The plurality of line segments 30 may include a first group of line segments 30*a* (see also, e.g., FIG. 6A), a second group of line segments 30*b*, (see also, e.g., FIG. 6B) and a third group of line segments 30*c* (see also, e.g., FIG. 6C).

Referring to FIGS. 2A-2B, an article of clothing is shown generally at 300. The article of clothing 300 may be worn by a wearer for utilization in any number of athletic activities including, but not limited to surfing, skiing and bicycling. In this regard, in some implementations, the article of clothing 300 may include a wetsuit or portion thereof. The article of clothing 300 is formed by at least two materials including a substrate material 312 and a flocking material 314.

The flocking material 314 may include a plurality of the small fiber particles 15 (i.e., flock), as illustrated in FIG. 4A. In the worn state (e.g., FIGS. 2A and 2B), the article of clothing 300 may be worn by the wearer 11 such that the substrate material 312 and/or the flocking material 314 engages the wearer 11. For example, as illustrated in FIG. 4A, the flocking material 314 may engage the wearer's skin 17. In this regard, the flocking material 314 may enhance the substrate material 312 in terms of tactile sensation (e.g., the flocking material 314 may provide a soft and comfortable feel), aesthetics, color and appearance while providing insulation and slip-or-grip friction to the substrate material 312. Such use of flocking material 314 may be well-suited for use in wet conditions such as a primary or base layer of clothing under a wetsuit formed by substrate material 12. In this regard, as illustrated in FIG. 4A, the flocking material 314 may permit fluid (e.g., water, air, etc.) to flow in the gap 19.

Referring to FIGS. 4A-4B, in some instances, the flocking material 314 may be attached to the substrate material 312 with an intervening material 316 such as an adhesive material 316, for example. In other examples, the flocking material 314 may be coupled to the substrate material 312 without the intervening material 316.

Referring to FIGS. 4A-4B, the substrate material 312 may include a base layer 318 having an inner surface 320, an outer surface 322, and a plurality of side surface 324. Referring to FIG. 4B, the inner surface 320 may oppose the outer surface 322 such that the plurality of side surfaces 324 join the inner surface 320 to the outer surface 322. In an example, seen in FIG. 2A, the plurality of side surfaces 324 include a first side surface 324*a*, a second side surface 324*b* and a third side surface 324*c*.

Referring to FIG. 4B, the base layer 318 forms a plurality of openings 326 through which a portion (e.g., arm, leg, waist, neck) of the wearer 11 may extend. Referring to FIG. 2A, in an example, the plurality of openings 326 include a first opening 326*a*, a second opening 326*b* and a third opening 326*c*. Referring to FIG. 4B, each opening 326*a*-326*c* of the plurality of openings 326 may be defined by the intersection of the inner surface 320 and a side surface 324*a*-324*c* of the plurality of side surfaces 324. For example, (1) the first opening 326*a* may be defined by the intersection of the inner surface 320 and the first side surface 324*a*; (2) the second opening 326*b* may be defined by the intersection of the inner surface 320 and the second side surface 324*b*; and (3) the third opening 326*c* may be defined by the intersection of the inner surface 320 and the third side surface 324*c*.

Referring to FIG. 2A, the base layer 318 may include a body-receiving portion 350 and at least one limb-receiving portion 375 extending from the body-receiving portion 350. In some implementations, the at least one limb-receiving portion 375 includes a first sleeve portion 375*a* and a second sleeve portion 375*b*.

The body-receiving portion 350 is sized for arrangement about a groin of the wearer 11. The first sleeve portion 375*a* is sized for arrangement about a right leg of the wearer 11. The second sleeve portion 375*b* is sized for arrangement about a left leg of the wearer 11. Collectively, the body-receiving portion 350, the first sleeve portion 375*a* and the second sleeve portion 375*b* are sized for use as a pair of pants (such as, e.g., a pair of capris).

The first opening 326*a* is formed by the body-receiving portion 350 and is sized for circumscribing a waist region (e.g., a region generally below the ribs and above the hips H) of the wearer 11. The second opening 326*b* is formed by the first sleeve portion 375*a* and is sized for circumscribing a right leg of the wearer 11 slightly beyond the right knee K (e.g., at approximately about an upper calf region) of the wearer 11. The third opening 326*c* is formed by the second sleeve portion 375*b* and is sized for circumscribing a left leg of the wearer 11 slightly beyond the left knee K (e.g., at approximately about an upper calf region) of the wearer 11.

Referring to FIGS. 4A-4B, the flocking material 314 may be attached to the inner surface 320 of the base layer 318. In some examples, as seen in FIG. 4B, the flocking material 314 is arranged upon the inner surface 320 of the base layer 318 at the opening 326*a*, 326*b*, 326*c* (i.e., the flocking material 314 is arranged at a distance D approximately equal to zero from the side surface 324*a*, 324*b*, 324*c*). In some instances, the flocking material 314 may be arranged upon the inner surface 320 of the base layer 318 near the opening 326*a*, 326*b*, 326*c* (i.e., the flocking material 314 is arranged at a distance D approximately equal to but slightly greater than zero from the side surface 324*a*, 324*b*, 324*c*).

In implementations where the flocking material 314 is arranged at or near the opening 326*a*, 326*b*, 326*c*, the flocking material 314, including the fiber particles 15, may be arranged in the form of a loop 328 or a plurality of segments forming an interrupted loop 328. The loop 328 or plurality of segments forming the interrupted loop 328 may directly oppose the wearer's skin 17 to provide a soft or comfortable feel while concurrently restricting movement (e.g., sliding) of the article of clothing 300 about the plurality of openings 326 in order to retain the article of clothing 300 to the wearer 11.

In other examples, as seen in FIGS. 2A and 4A, the flocking material 314 is arranged upon the inner surface 320 of the base layer 318 away from the plurality of openings 326; in such instances, the flocking material 314 is selectively sized for arrangement about joints or points of articulation (e.g., a left hip region H, a right hip region H, a left knee region K and a right knee region K) of the wearer. Referring to FIGS. 5 and 6A-6C, when the flocking material 314 is selectively sized for arrangement about joints or points of articulation of a wearer, the flocking material 314 may be arranged in the form of a pattern of a plurality of line segments 30 that are connected in an intersecting relationship. For example, the flocking material 314 may be disposed between, and bounded by, a plurality of the line segments 30. The plurality of line segments 30 may include a first group of line segments 30*a* (see also, e.g., FIG. 6A), a second group of line segments 30*b*, (see also, e.g., FIG. 6B) and a third group of line segments 30*c* (see also, e.g., FIG. 6C).

Figure 3A:
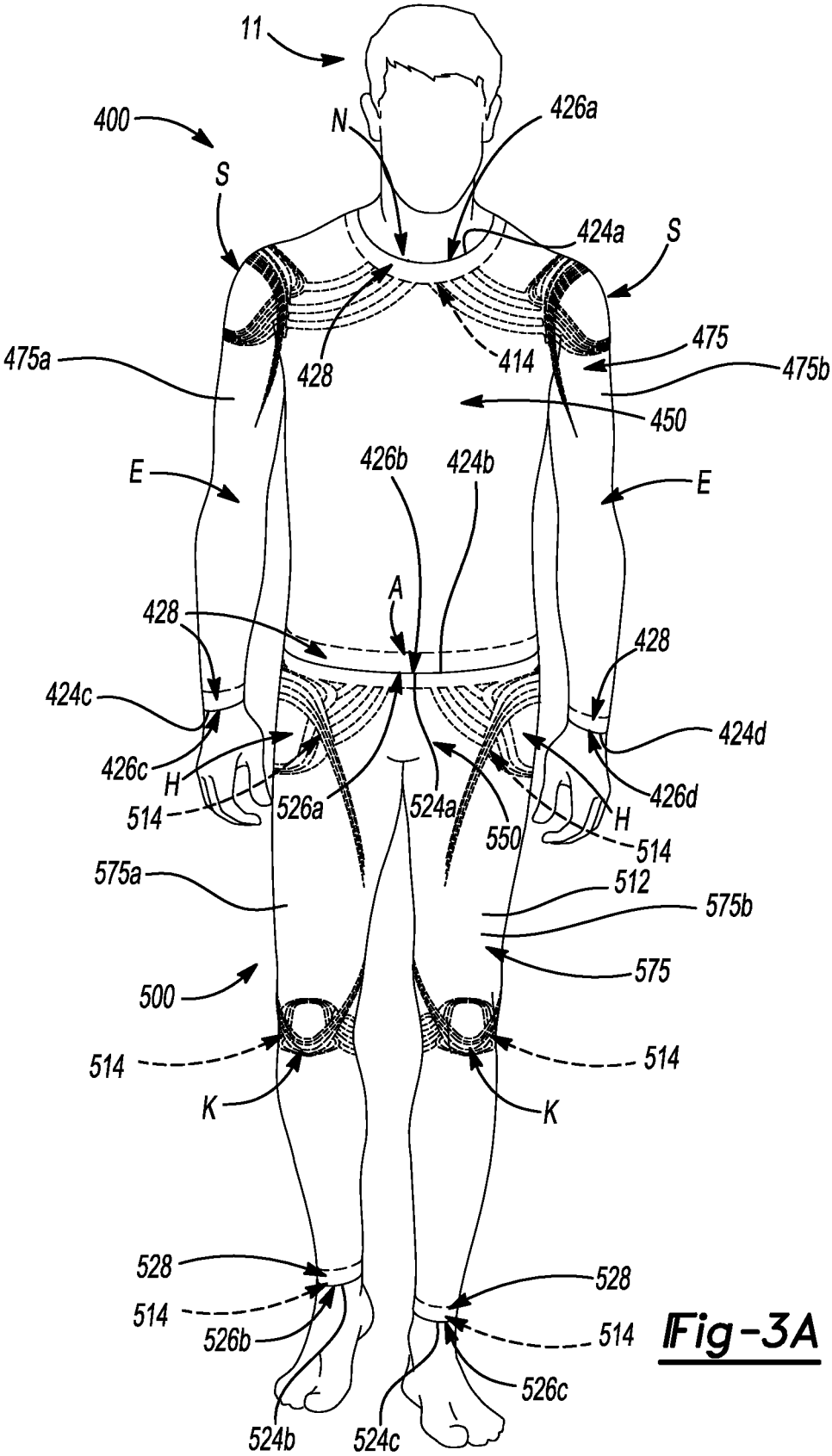
FIG. 3A is a front view of a first article of clothing, such as, for example, a long-sleeve shirt, and a second article of clothing, such as, for example, a pair of trousers in accordance with the principles of the present disclosure.
Figure 3B:
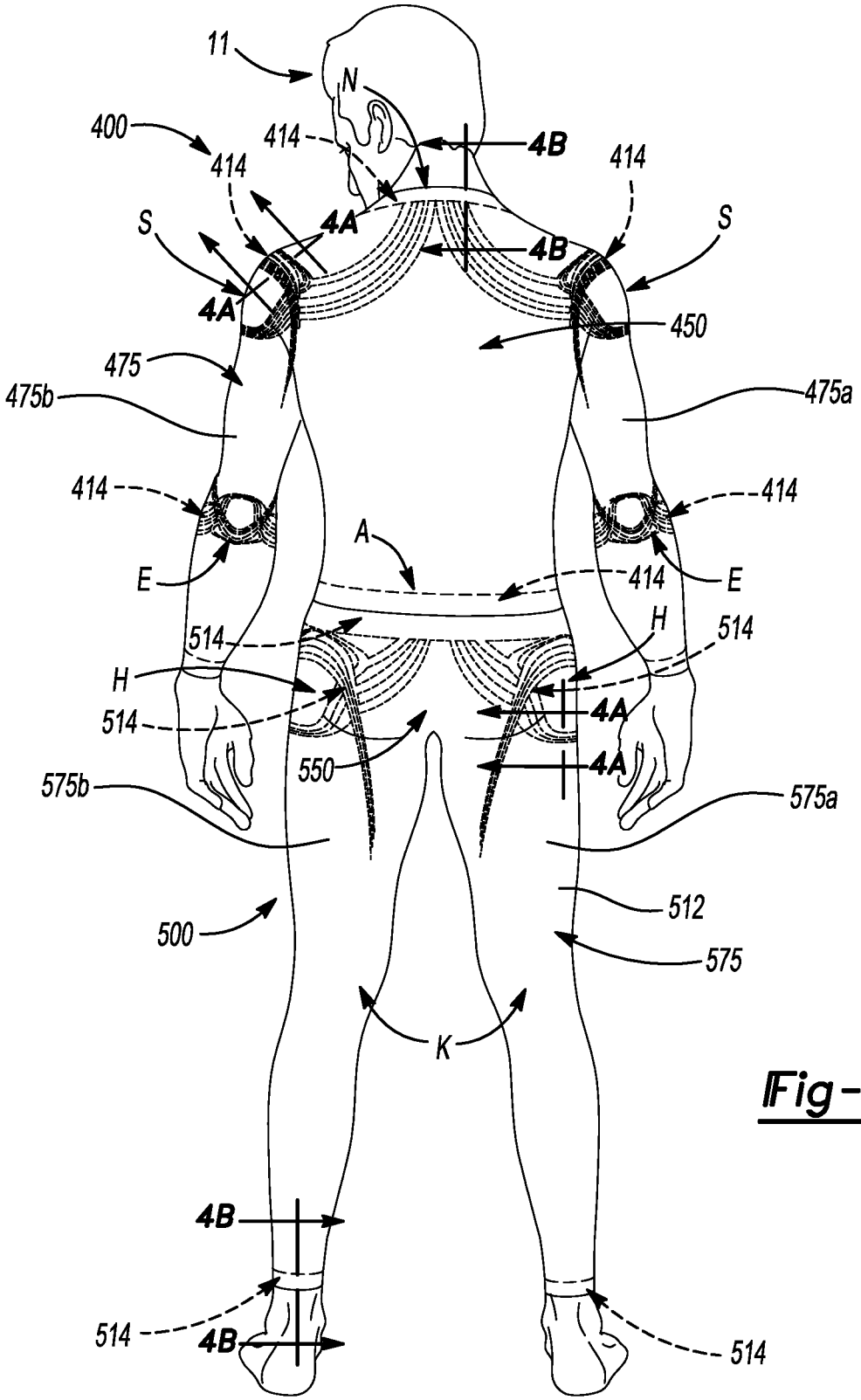
FIG. 3B is a rear view of the first article of clothing and the second article of clothing of FIG. 3A.

Referring to FIGS. 3A-3B, an article of clothing is shown generally at 400. The article of clothing 400 may be worn by a wearer for utilization in any number of athletic activities including, but not limited to surfing, skiing and bicycling. In this regard, in some implementations, the article of clothing 400 may include a wetsuit or portion thereof. The article of clothing 400 may include a substrate material 412 and a flocking material 414.

The flocking material 414 may include a plurality of the small fiber particles 15 (i.e., flock), as illustrated in FIG. 4A. In the worn state (e.g., FIGS. 2A and 2B), the article of clothing 200 may be worn by the wearer 11 such that the substrate material 212 and/or the flocking material 214 engages the wearer 11. For example, as illustrated in FIG. 4A, the flocking material 214 may engage the wearer's skin 17. In this regard, the flocking material 414 may enhance the substrate material 412 in terms of tactile sensation (e.g., the flocking material 414 may provide a soft and comfortable feel), aesthetics, color and appearance while providing insulation and slip-or-grip friction to the substrate material 412. Such use of flocking material 414 may be well-suited for use in wet conditions such as a primary or base layer of clothing under a wetsuit formed by the substrate material 412. In this regard, as illustrated in FIG. 4A, the flocking material 414 may permit a fluid (e.g., water, air, etc.) to flow in the gap 19 between the wearer's skin 17 and the substrate material 412.

Referring to FIGS. 4A-4B, in some instances, the flocking material 414 may be attached to the substrate material 412 with, an intervening material 416, such as an adhesive, for example. In other examples, the flocking material 414 may be coupled to the substrate material 412 without the use of the intervening material 416.

Referring to FIGS. 4A-4B, the substrate material 412 may include a base layer 418 having an inner surface 420, an outer surface 422, and a plurality of side surfaces 424. Referring to FIG. 4B, the inner surface 420 may oppose the outer surface 422 such that the plurality of side surfaces 424 join the inner surface 420 to the outer surface 422. In an example, seen in FIG. 3A, the plurality of side surfaces 424 include a first side surface 424*a*, a second side surface 424*b*, a third side surface 424*c* and a fourth side surface 424*d*.

Referring to FIG. 4B, the base layer 418 forms a plurality of openings 426 through which a portion (e.g., arm, leg, waist, neck) of the wearer 11 may extend. Referring to FIG. 3A, in an example, the plurality of openings 426 include a first opening 426*a*, a second opening 426*b*, a third opening 426*c* and a fourth opening 426*d*. Referring to FIG. 4B, each opening 426*a*-426*d* of the plurality of openings 426 may be defined by the intersection of the inner surface 420 and a side surface 424*a*-424*d* of the plurality of side surfaces 424; for example, (1) the first opening 426*a* may be defined by the intersection of the inner surface 420 and the first side surface 424*a*; (2) the second opening 426*b* may be defined by the intersection of the inner surface 420 and the second side surface 424*b*; (3) the third opening 426*c* may be defined by the intersection of the inner surface 420 and the third side surface 424*c*; and (4) the fourth opening 426*d* may be defined by the intersection of the inner surface 420 and the fourth side surface 424*d*.

Referring to FIG. 3A, the base layer 418 may include a body-receiving portion 450 and at least one limb-receiving portion 475 extending from the body-receiving portion 450. In some implementations, the at least one limb-receiving portion 475 includes a first sleeve portion 475*a* and a second sleeve portion 475*b*.

The body-receiving portion 450 is sized for arrangement about a torso of a wearer. The first sleeve portion 475*a* is sized for arrangement about a right arm of the wearer 11. The second sleeve portion 475*b* is sized for arrangement about a left arm of the wearer 11. Collectively, the body-receiving portion 450, the first sleeve portion 475*a* and the second sleeve portion 475*b* are sized for use as a shirt (such as, e.g., a long-sleeve shirt).

The first opening 426*a* is formed by the body-receiving portion 450 and is sized for circumscribing a neck N of the wearer 11. The second opening 426*b* is formed by the body-receiving portion 450 and is sized for circumscribing an abdominal region A (e.g., a region generally bounded by the diaphragm and pelvis) of the wearer 11. The third opening 426*c* is formed by the first sleeve portion 475*a* and is sized for circumscribing a right arm of the wearer 11 beyond the right elbow E (e.g., at approximately about a wrist region) of the wearer 11. The fourth opening 426*d* is formed by the second sleeve portion 475*b* and is sized for circumscribing a left arm of the wearer 11 beyond the left elbow E (e.g., at approximately about a wrist region) of the wearer 11.

Referring to FIGS. 4A-4B, the flocking material 414 may be attached to the inner surface 420 of the base layer 418. In some examples, as seen in FIG. 4B, the flocking material 414 is arranged upon the inner surface 420 of the base layer 418 at the opening 426*a*, 426*b*, 426*c*, 426*d* (i.e., the flocking material 414 is arranged at a distance D approximately equal to zero from the side surface 424*a*, 424*b*, 424*c*, 424*d*). In some instances, the flocking material 414 may be arranged upon the inner surface 420 of the base layer 418 near the opening 426*a*, 426*b*, 426*c*, 426*d* (i.e., the flocking material 414 is arranged at a distance D approximately equal to but slightly greater than zero from the side surface 424*a*, 424*b*, 424*c*, 424*d*).

In implementations where the flocking material 414 is arranged at or near the opening 426*a*, 426*b*, 426*c*, 426*d*, the flocking material 414, including the fiber particles 15, may be arranged in the form of a loop 428 or a plurality of segments forming an interrupted loop 428. The loop 428 or plurality of segments forming the interrupted loop 428 may directly oppose the wearer's skin 17 to provide a soft or comfortable feel while concurrently restricting movement (e.g., sliding) of the article of clothing 400 about the plurality of openings 426 in order to retain the article of clothing 400 to the wearer 11.

In other examples, as seen in FIGS. 3A and 4A, the flocking material 414 is arranged upon the inner surface 420 of the base layer 418 away from the plurality of openings 426; in such instances, the flocking material 414 is selectively sized for arrangement about joints or points of articulation (e.g., a left shoulder region S, a right shoulder region S, a left elbow region E and a right elbow region E) of the wearer. Referring to FIGS. 5 and 6A-6C, when the flocking material 414 is selectively sized for arrangement about joints or points of articulation of a wearer, the flocking material 414 may be arranged in the form of a pattern of a plurality of line segments 30 that are connected in an intersecting relationship. For example, the flocking material 14 may be disposed between, and bounded by, a plurality of the line segments 30. The plurality of line segments 30 may include a first group of line segments 30*a* (see also, e.g., FIG. 6A), a second group of line segments 30*b*, (see also, e.g., FIG. 6B) and a third group of line segments 30*c* (see also, e.g., FIG. 6C).

Referring to FIGS. 3A-3C, an article of clothing is shown generally at 500. The article of clothing 500 may be worn by a wearer for utilization in any number of athletic activities including, but not limited to surfing, skiing and bicycling. In this regard, in some implementations, the article of clothing 500 may include a wetsuit or portion thereof. The article of clothing 500 may include a substrate material 512 and a flocking material 514.

The flocking material 514 may include a plurality of the small fiber particles 15 (i.e., flock), as illustrated in FIG. 4A. In the worn state (e.g., FIGS. 2A and 2B), the article of clothing 200 may be worn by the wearer 11 such that the substrate material 212 and/or the flocking material 214 engages the wearer 11. For example, as illustrated in FIG. 4A, the flocking material 214 may engage the wearer's skin 17. In this regard, the flocking material 514 may enhance the substrate material 512 in terms of tactile sensation (e.g., the flocking material 514 may provide a soft and comfortable feel), aesthetics, color and appearance while providing insulation and slip-or-grip friction to the substrate material 512. Such use of flocking material 514 may be well-suited for use in wet conditions. For example, the flocking material 514 may be disposed as a primary or base layer of clothing under a wetsuit formed by the substrate material 512. In this regard, as illustrated in FIG. 4A, the flocking material 514 may permit fluid (e.g., water, air, etc.) to flow between the wearer's skin 17 and the substrate material 512.

Referring to FIGS. 4A-4B, in some instances, the flocking material 514 may be attached to the substrate material 512 with an intervening material 516, such as an adhesive, for example. In other examples, the flocking material 514 may be coupled to the substrate material 512 without the use of the intervening material 516.

Referring to FIGS. 4A-4B, the substrate material 512 may include a base layer 518 having an inner surface 520, an outer surface 522, and a plurality of side surfaces 524. Referring to FIG. 4B, the inner surface 520 may oppose the outer surface 522 such that the plurality of side surfaces 524 join the inner surface 520 to the outer surface 522. In an example, seen in FIG. 3A, the plurality of side surfaces 524 include a first side surface 524*a*, a second side surface 524*b* and a third side surface 524*c*.

Referring to FIG. 4B, the base layer 518 forms a plurality of openings 526 through which a portion (e.g., arm, let waist, neck) of the wearer 11 may extend. Referring to FIG. 3A, in an example, the plurality of openings 526 include a first opening 526*a*, a second opening 526*b* and a third opening 526*c*. Referring to FIG. 4B, each opening 526*a*-526*c* of the plurality of openings 526 may be defined by the intersection of the inner surface 520 and a side surface 524*a*-524*c* of the plurality of side surfaces 524; for example, (1) the first opening 526*a* may be defined by the intersection of the inner surface 520 and the first side surface 524*a*; (2) the second opening 526*b* may be defined by the intersection of the inner surface 520 and the second side surface 524*b*; and (3) the third opening 526*c* may be defined by the intersection of the inner surface 520 and the third side surface 524*c*.

Referring to FIG. 3A, the base layer 518 may include a body-receiving portion 550 and at least one limb-receiving portion 575 extending from the body-receiving portion 550. In some implementations, the at least one limb-receiving portion 575 includes a first sleeve portion 575*a* and a second sleeve portion 575*b*.

The body-receiving portion 550 is sized for arrangement about a groin of the wearer 11. The first sleeve portion 575*a* is sized for arrangement about a right leg of the wearer 11. The second sleeve portion 575*b* is sized for arrangement about a left leg of the wearer 11. Collectively, the body-receiving portion 550, the first sleeve portion 575*a* and the second sleeve portion 575*b* are sized for use as a pair of pants (such as, e.g., a pair of trousers).

The first opening 526*a* is formed by the body-receiving portion 550 and is sized for circumscribing a waist region (e.g., a region generally below the ribs and above the hips H) of the wearer 11. The second opening 526*b* is formed by the first sleeve portion 575*a* and is sized for circumscribing a right leg of the wearer 11 beyond the right knee K (e.g., at approximately about an ankle region) of the wearer 11. The third opening 526*c* is formed by the second sleeve portion 575*b* and is sized for circumscribing a left leg of the wearer 11 beyond the left knee K (e.g., at approximately about an ankle region) of the wearer 11.

Referring to FIGS. 4A-4B, the flocking material 514 may be attached to the inner surface 520 of the base layer 518. In some examples, as seen in FIG. 4B, the flocking material 514 is arranged upon the inner surface 520 of the base layer 518 at the opening 526*a*, 526*b*, 526*c* (i.e., the flocking material 514 is arranged at a distance D approximately equal to zero from the side surface 524*a*, 524*b*, 524*c*). In some instances, the flocking material 514 may be arranged upon the inner surface 520 of the base layer 518 near the opening 526*a*, 526*b*, 526*c* (i.e., the flocking material 514 is arranged at a distance D approximately equal to but slightly greater than zero from the side surface 524*a*, 524*b*, 524*c*).

In implementations where the flocking material 514 is arranged at or near the opening 526*a*, 526*b*, 526*c*, the flocking material 514, including the fiber particles 15, may be arranged in the form of a loop 528 or a plurality of segments forming an interrupted loop 528. The loop 528 or plurality of segments forming the interrupted loop 528 may directly oppose the wearer's skin 17 to provide a soft or comfortable feel while concurrently restricting movement (e.g., sliding) of the article of clothing 500 about the plurality of openings 526 in order to retain the article of clothing 500 to the wearer 11.

In other examples, as seen in FIGS. 3A and 4A, the flocking material 514 is arranged upon the inner surface 520 of the base layer 518 away from the plurality of openings 526; in such instances, the flocking material 514 is selectively sized for arrangement about joints or points of articulation (e.g., a left hip region H, a right hip region H, a left knee region K and a right knee region K) of the wearer. Referring to FIGS. 5 and 6A-6C, when the flocking material 514 is selectively sized for arrangement about joints or points of articulation of a wearer, the flocking material 514 may be arranged in the form of a pattern of a plurality of line segments 30 that are connected in an intersecting relationship. For example, the flocking material 14 may be disposed between, and bounded by, a plurality of the line segments 30. The plurality of line segments 30 may include a first group of line segments 30*a* (see also, e.g., FIG. 6A), a second group of line segments 30*b*, (see also, e.g., FIG. 6B) and a third group of line segments 30*c* (see also, e.g., FIG. 6C).

The following Clauses provide an exemplary configuration for an article of clothing described above.

Clause 1: An article of clothing comprising a substrate material including an inner surface and an outer surface disposed on an opposite side of the substrate material than the inner surface, the substrate material forming a body-receiving portion and a limb-receiving portion extending from the body-receiving portion, the body-receiving portion including a first opening sized for circumscribing a neck of a wearer, the limb-receiving portion including a second opening sized for circumscribing a limb of the wearer and a flocking material arranged adjacent the inner surface of the substrate material proximate at least one of the first opening and the second opening.

Clause 2: The article of clothing of Clause 1, wherein the flocking material surrounds the first opening.

Clause 3: The article of clothing of Clause 2, wherein the flocking material surrounds the second opening.

Clause 4: The article of clothing of Clause 1, wherein the flocking material surrounds the second opening.

Clause 5: The article of clothing of Clause 1, wherein the limb-receiving portion includes a joint portion operable to oppose a joint of the wearer during use.

Clause 6: The article of clothing of Clause 5, wherein the joint portion includes the flocking material.

Clause 7: The article of clothing of Clause 6, wherein the flocking material of the joint portion is disposed adjacent to the inner surface in a substantially circular pattern operable to at least partially surround the joint of the wearer during use.

Clause 8: The article of clothing of Clause 6, wherein the joint is an elbow joint.

Clause 9: The article of clothing of Clause 6, wherein the joint is a shoulder joint.

Clause 10: An article of clothing comprising a substrate material including an inner surface and an outer surface disposed on an opposite side of the substrate material than the inner surface, the substrate material forming a body-receiving portion and a limb-receiving portion extending from the body-receiving portion, the body-receiving portion including a first opening sized for circumscribing a waist of a wearer, the limb-receiving portion including a second opening sized for circumscribing a limb of the wearer and a flocking material arranged adjacent the inner surface of the substrate material proximate at least one of the first opening and the second opening.

Clause 11: The article of clothing of Clause 10, wherein the flocking material surrounds the first opening.

Clause 12: The article of clothing of Clause 11, wherein the flocking material surrounds the second opening.

Clause 13: The article of clothing of Clause 10, wherein the flocking material surrounds the second opening.

Clause 14: The article of clothing of Clause 10, wherein the limb-receiving portion includes a joint portion operable to oppose a joint of the wearer during use.

Clause 15: The article of clothing of Clause 14, wherein the joint portion includes the flocking material.

Clause 16: The article of clothing of Clause 15, wherein the flocking material of the joint portion is disposed adjacent to the inner surface in a substantially circular pattern operable to at least partially surround the joint of the wearer during use.

Clause 17: The article of clothing of Clause 15, wherein the joint is a knee joint.

Clause 18: The article of clothing of Clause 15, wherein the joint is a hip joint.

Clause 19: An article of clothing comprising a substrate material including an inner surface and an outer surface disposed on an opposite side of the substrate material than the inner surface, the substrate material forming a body-receiving portion and a limb-receiving portion extending from the body-receiving portion, the limb-receiving portion including a joint portion operable to oppose a joint of a wearer and a flocking material arranged adjacent the inner surface of the substrate material proximate the joint portion and defining an opening operable to receive the joint of the wearer during use, the flocking material operable to surround the joint at the opening.

Clause 20: The article of clothing of Clause 19, wherein the flocking material includes a first group of line segments and a second group of line segments.

Clause 21: The article of clothing of Clause 20, wherein the first group of line segments includes a plurality of individual first line segments and the second group of line segments includes a plurality of individual second line segments.

Clause 22: The article of clothing of Clause 21, wherein the plurality of individual first line segments include a substantially U-shape and the plurality of individual second line segments include a substantially U-shape.

Clause 23: The article of clothing of Clause 21, wherein the plurality of individual first line segments oppose the plurality of individual second line segments to define the opening.

Clause 24: The article of clothing of Clause 21, wherein an innermost one of the plurality of individual first line segments contacts an innermost one of the plurality of individual second line segments to define and surround the opening.

Clause 25: The article of clothing of Clause 21, wherein at least two of the plurality of individual first line segments are parallel to one another and at least two of the plurality of individual second line segments are parallel to one another.

Clause 26: The article of clothing of Clause 21, wherein the plurality of individual first line segments are spaced apart from one another along a length of the individual first line segments and the plurality of individual second line segments are spaced apart from one another along a length of the individual second line segments.

Clause 27: The article of clothing of Clause 21, wherein the plurality of individual first line segments are concentric with one another and the plurality of individual second line segments are concentric with one another.

Clause 28: The article of clothing of Clause 21, wherein the plurality of individual first line segments are concentric with the plurality of individual second line segments.

Clause 29: The article of clothing of Clause 19, wherein the opening includes one of a substantially circular shape and a shape defining a pentagon.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of clothing comprising:

a substrate material including an inner surface and an outer surface disposed on an opposite side of the substrate material than the inner surface, the substrate material forming a pair of pants having a waist opening and a leg portion extending from the waist opening, the leg portion including a first end attached to the waist opening, a second end disposed at an opposite end of the leg portion than the first end and defining a leg opening operable to circumscribe a leg of a wearer, and a joint portion configured to coincide with a knee joint of the wearer at the same time that the waist opening is configured to reside around a waist of the wearer and the leg portion is configured to reside around a leg of the wearer; and a flocking material arranged upon the inner surface of the substrate material between the first end of the leg portion and the second end of the leg portion and fully circumscribing the joint portion of the substrate material, the flocking material including a plurality of flocking material line segments formed from the flocking material and connected in an intersecting relationship to define a gap exposing the inner surface of the substrate material and operable to receive the knee joint of the wearer during use, the flocking material operable to surround the knee joint at the gap.

2. The article of clothing of claim 1, wherein the plurality of flocking material line segments includes a first group of line segments and a second group of line segments.

3. The article of clothing of claim 2, wherein the first group of line segments includes a plurality of individual first line segments and the second group of line segments includes a plurality of individual second line segments.

4. The article of clothing of claim 3, wherein the plurality of individual first line segments includes individual first line segments forming a substantially U-shape and the plurality of individual second line segments includes individual second line segments forming a substantially U-shape.

5. The article of clothing of claim 3, wherein individual first line segments of the plurality of individual first line segments oppose individual second line segments of the plurality of individual second line segments to define the gap.

6. The article of clothing of claim 3, wherein an innermost one of the plurality of individual first line segments contacts an innermost one of the plurality of individual second line segments to define and surround the gap.

7. The article of clothing of claim 3, wherein at least two of the plurality of individual first line segments are parallel to one another and at least two of the plurality of individual second line segments are parallel to one another.

8. The article of clothing of claim 3, wherein individual first line segments of the plurality of individual first line segments are spaced apart from one another along a length of the individual first line segments and individual second line segments of the plurality of individual second line segments are spaced apart from one another along a length of the individual second line segments.

9. The article of clothing of claim 3, wherein individual first line segments of the plurality of individual first line segments are concentric with one another and individual second line segments of the plurality of individual second line segments are concentric with one another.

10. The article of clothing of claim 3, wherein individual first line segments of the plurality of individual first line segments are concentric with individual second line segments of the plurality of individual second line segments.

11. The article of clothing of claim 1, wherein the gap includes one of a substantially circular shape and a shape defining a pentagon.

12. An article of clothing comprising:

a substrate material including an inner surface and an outer surface disposed on an opposite side of the substrate material than the inner surface, the substrate material forming a pair of pants having a waist opening and a leg portion extending from the waist opening, the leg portion including a first end attached to the waist opening, a second end disposed at an opposite end of the leg portion than the first end and defining a leg opening operable to circumscribe a leg of a wearer, and a joint portion spaced apart from the first end and the second end and configured to coincide with a knee joint of the wearer at the same time that the waist opening is configured to reside around a waist of the wearer and the leg portion is configured to reside around a leg of the wearer; and a flocking material arranged upon the inner surface of the substrate material and fully surrounding the joint portion to define a gap exposing the inner surface of the substrate material and operable to receive the knee joint of the wearer during use, the flocking material including a plurality of flocking material line segments formed from the flocking material and connected in an intersecting relationship.

13. The article of clothing of claim 12, wherein the plurality of flocking material line segments includes a first group of line segments and a second group of line segments.

14. The article of clothing of claim 13, wherein the first group of line segments includes a plurality of individual first line segments and the second group of line segments includes a plurality of individual second line segments.

15. The article of clothing of claim 14, wherein individual first line segments of the plurality of individual first line segments include a substantially U-shape and individual second line segments of the plurality of individual second line segments include a substantially U-shape.

16. The article of clothing of claim 14, wherein individual first line segments of the plurality of individual first line segments oppose individual second line segments of the plurality of individual second line segments to define the gap.

17. The article of clothing of claim 14, wherein:

an innermost one of the plurality of individual first line segments contacts an innermost one of the plurality of individual second line segments to define and surround the gap;

at least two of the plurality of individual first line segments are parallel to one another and at least two of the plurality of individual second line segments are parallel to one another; and individual first line segments of the plurality of individual first line segments are spaced apart from one another along a length of the individual first line segments and individual second line segments of the plurality of individual second line segments are spaced apart from one another along a length of the individual second line segments.

18. The article of clothing of claim 14, wherein individual first line segments of the plurality of individual first line segments are concentric with one another and individual second line segments of the plurality of individual second line segments are concentric with one another.

19. The article of clothing of claim 14, wherein individual first line segments of the plurality of individual first line segments are concentric with individual second line segments of the plurality of individual second line segments.

20. The article of clothing of claim 12, wherein the flocking material surrounds at least one of the waist opening and the leg opening.

* * * * *